US005087136A

United States Patent [19]

Nakajima et al.

[11] Patent Number: 5,087,136

[45] Date of Patent: Feb. 11, 1992

[54] PRINTING MECHANISM WITH A CAM AND GROOVE ARRANGEMENT

[75] Inventors: Hiroharu Nakajima, Kodaira; Naohisa Suzuki, Yokohama; Michihisa Kumamoto, Chofu, all of Japan

[73] Assignee: Canon Kabushiki Kaisha, Tokyo, Japan

[21] Appl. No.: 722,518

[22] Filed: Jun. 27, 1991

Related U.S. Application Data

[60] Division of Ser. No. 634,825, Jan. 2, 1991, Pat. No. 5,048,988, which is a continuation of Ser. No. 535,296, Jun. 8, 1990, abandoned, which is a continuation of Ser. No. 185,345, Apr. 25, 1988, abandoned, which is a continuation of Ser. No. 815,057, Dec. 31, 1985, abandoned.

[30] Foreign Application Priority Data

Jan. 7, 1985 [JP] Japan ..... 60-000665

[51] Int. Cl.[5] ..... B41J 35/22

[52] U.S. Cl. ..... 400/214; 400/697.1

[58] Field of Search ..... 400/208, 223, 213, 214, 400/215, 216, 216.1, 697.1, 144.2

[56] References Cited

U.S. PATENT DOCUMENTS

| | | | |
|---|---|---|---|
| 4,411,541 | 10/1983 | Mansfeld et al. | 400/213 |
| 4,533,267 | 8/1985 | Kurachi et al. | 400/214 |
| 4,538,931 | 9/1985 | Nagashima | 400/697.1 |
| 4,601,596 | 7/1986 | Musso | 400/214 |
| 4,609,297 | 9/1986 | Hubner | 400/214 |
| 4,613,248 | 9/1986 | Iwase et al. | 400/697.1 |
| 4,637,744 | 1/1987 | Valle et al. | 400/216 |

FOREIGN PATENT DOCUMENTS

| | | |
|---|---|---|
| 0038215 | 10/1981 | European Pat. Off. . |
| 0075084 | 3/1983 | European Pat. Off. . |
| 0083394 | 7/1983 | European Pat. Off. . |
| 2362697 | 6/1975 | Fed. Rep. of Germany . |
| 2902487 | 7/1979 | Fed. Rep. of Germany . |
| 2931326 | 2/1981 | Fed. Rep. of Germany . |
| 3105229 | 12/1982 | Fed. Rep. of Germany . |
| 3301933 | 7/1984 | Fed. Rep. of Germany . |

OTHER PUBLICATIONS

Patent Abstracts of Japan, vol. 8, No. 100, May 11, 1984, JP 59-12891, Jan. 23, 1984.

IBM Technical Disclosure Bulletin, vol. 26, No. 3B, Aug. 1983, Variable Lift and Feed Increment Ribbon/-Correction Mechanism, Greenlief et al.

Patent Abstracts of Japan, vol. 5, No. 179, Nov. 17, 1981, JP 56-104438.

*Primary Examiner*—Eugene H. Eickholt

*Attorney, Agent, or Firm*—Fitzpatrick, Cella, Harper & Scinto

[57] ABSTRACT

A printing mechanism for printing on a recording medium includes a cam mechanism for moving an ink ribbon to an effecting position to act on the recording medium and an initial position for not acting on the recording medium. The cam mechanism includes a cam plate and a cam tracing pin guided in a cam groove within the cam plate, with the cam tracing pin traveling several courses in the cam groove. A driving device imparts rotary motion to the cam mechanism in two directions about a rotary axis and the cam tracing pin is guided in several stages of rotary motion.

3 Claims, 29 Drawing Sheets

PRINTING MECHANISM WITH A CAM AND GROOVE ARRANGEMENT

This application is a division of application Ser. No. 07/634,825 filed Jan. 2, 1991, now U.S. Pat. No. 5,048,988, which is a continuation of application Ser. No. 07/535,296, filed June 8, 1990, now abandoned, which is a continuation of application Ser. No. 07/185,345, filed Apr. 25, 1988, now abandoned, which is a continuation of application Ser. No. 06/815,057, field Dec. 31, 1985, now abandoned.

BACKGROUND OF THE INVENTION

1. Field of the Invention

The present invention relates to a recording apparatus in which recording operation is conducted by shifting a belt-shaped ribbon, such as a typewriter.

2. Description of the Prior Art

Recent developments in recording apparatus have realized economy in power consumption and miniaturization, and typewriters are now capable of various editing functions through the application of electronic technologies. However such developments are still not enough in certain areas. For example, for achieving control of advancement for various ribbons, it has been considered to prepare various cassettes corresponding to respective ribbons and incorporating different decelerating mechanisms. However such methods require different cassettes according to the ribbons, thus increasing the cost of the apparatus.

Also electric power is wasted since a constant voltage is supplied for drive regardless of the load.

Moreover, there have been required separate power supply circuits for a ribbon motor and a linear pulse motor, with a further separate selector circuit, so that the circuitry has inevitably been complex.

Furthermore, in the case of an abnormality for example in the descending motion of the ribbon, such as the absence of descent of the ribbon even after a predetermined time, the apparatus may develop a failure in trying to lower the ribbon.

Still further, noise generation is unavoidable in the carriage movement, particularly over a long period, since a constant voltage is always applied.

SUMMARY OF THE INVENTION

An object of the present invention is to provide a recording apparatus capable of shifting and advancing a ribbon in a more efficient and effective manner with a simple structure.

BRIEF DESCRIPTION OF THE DRAWINGS

FIGS. 7, 8-1 to 8-2 and 9-1 to 9-4 are schematic views showing the structure and function of a cam gear and a cam lever;

FIGS. 10 and 11-1 to 11-2 are schematic views showing the structure and function of a ribbon winding shaft;

FIGS. 22-1 and 22-2 are a flow chart of an output sequence of an MPU;

FIG. 24-1 is a flow chart for key entry process for a space key;

FIG. 24-2 is a flow chart for key entry process for back-space key;

DESCRIPTION OF THE PREFERRED EMBODIMENTS

Figure 1:
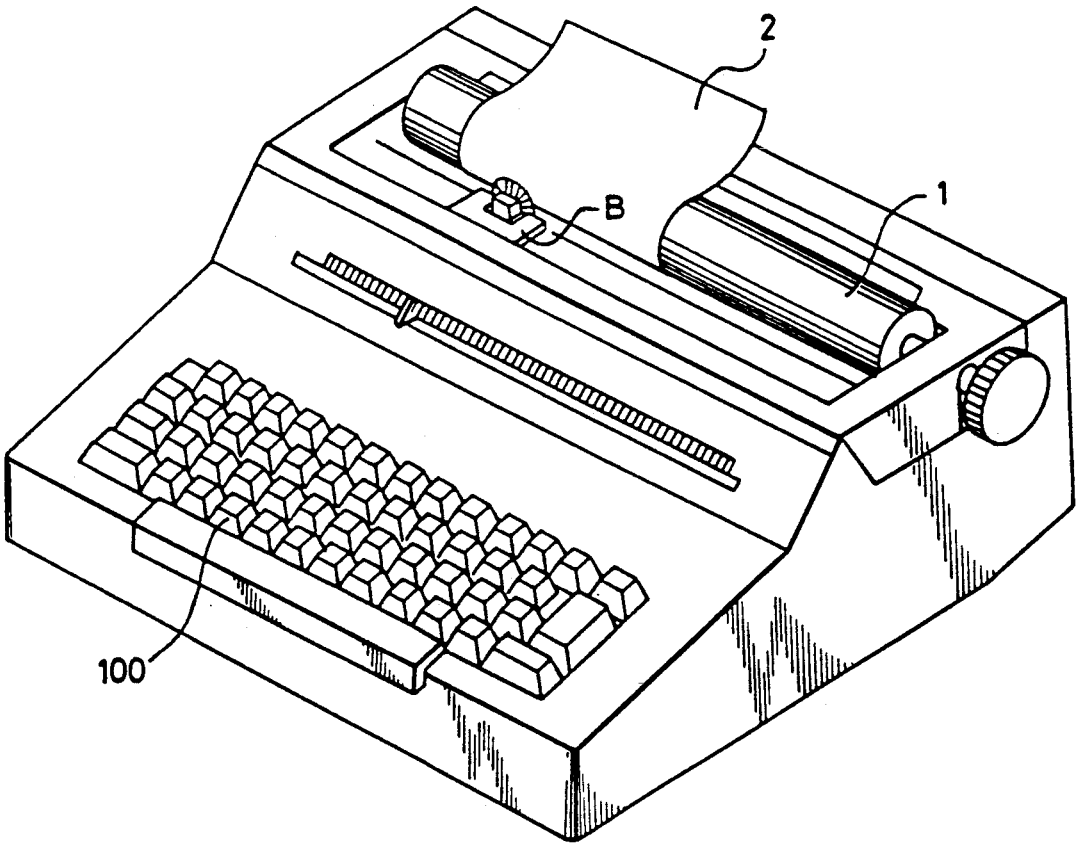
FIG. 1 is a perspective view of a typewriter embodying the present invention.

Now the present invention will be clarified in detail by embodiments thereof shown in the accompanying drawings. FIG. 1 is a perspective view of a typewriter in which the present invention is applicable, wherein shown are a keyboard 100 comprising alphabet keys, numeral keys, editing function keys etc,; a platen 1; an output medium 2 such as paper; and an output device B for printing desired information on the paper 2 as will be explained later.

Figure 2:
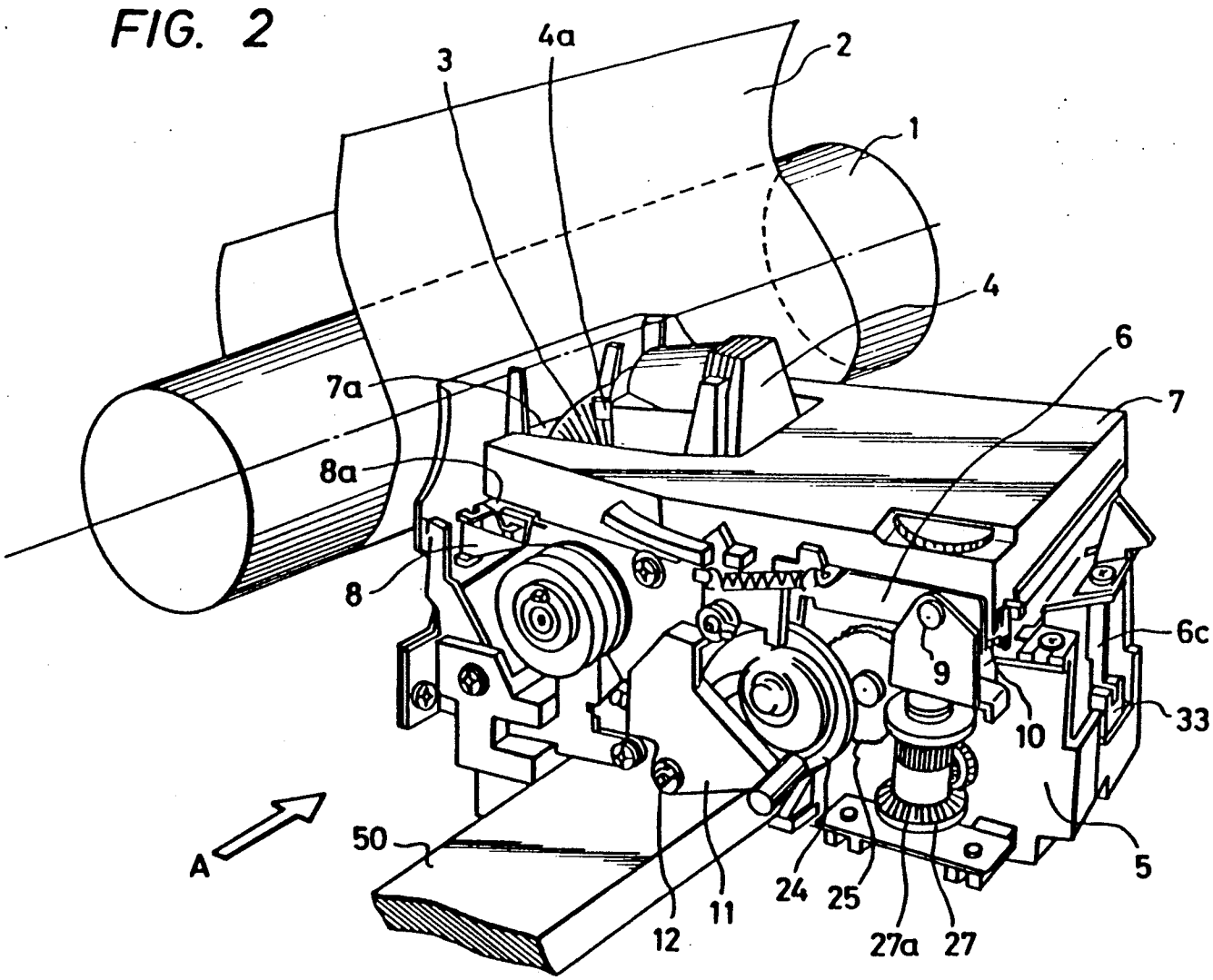
FIG. 2 is a perspective view of an output device B.
Figure 3:
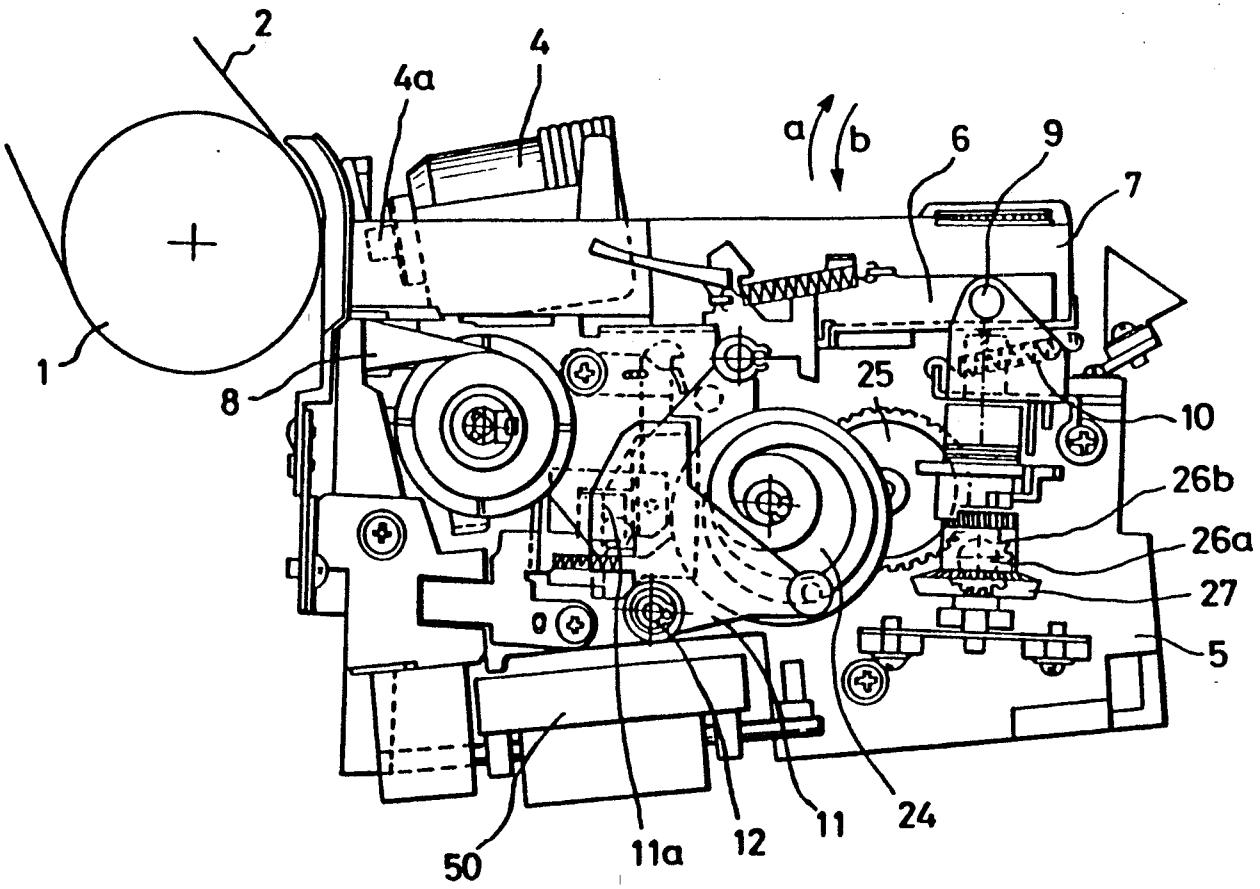
FIG. 3 is a lateral view of the output device B seen from a direction of arrow A shown in FIG. 2.
Figure 5:
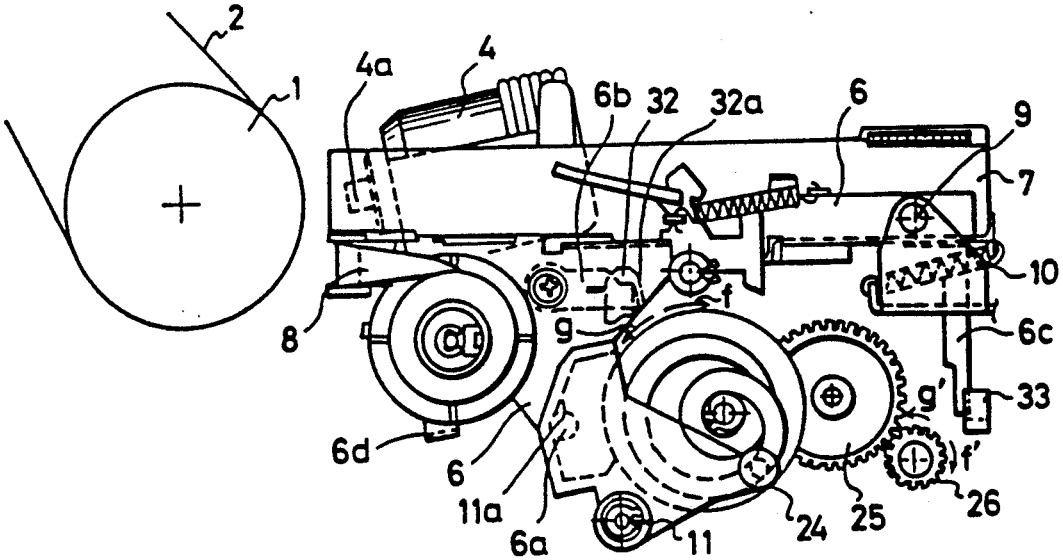
Figure 6:
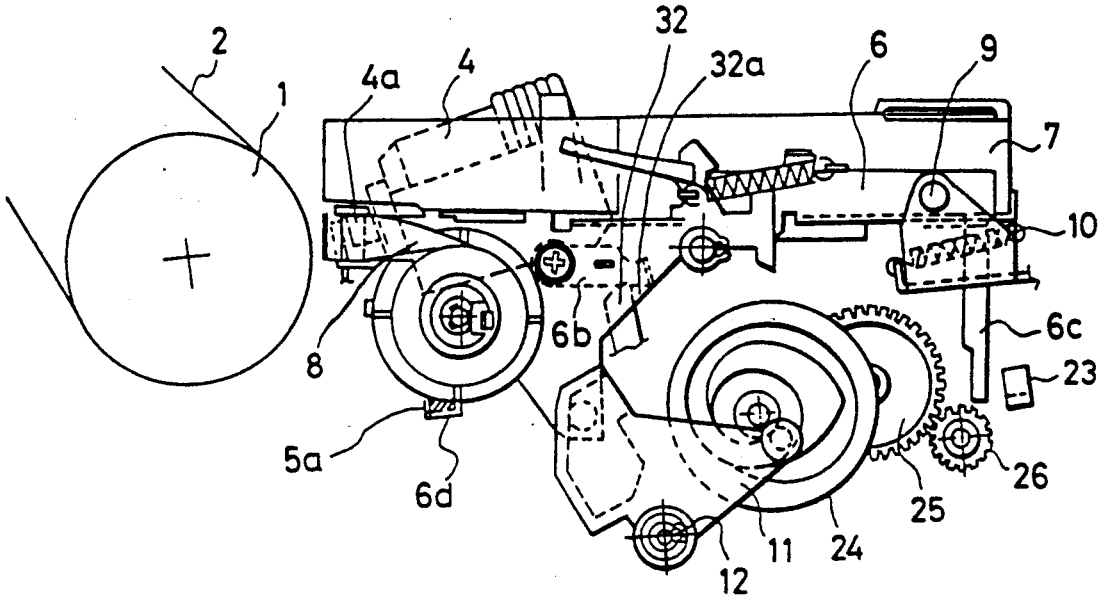
Figure 7:
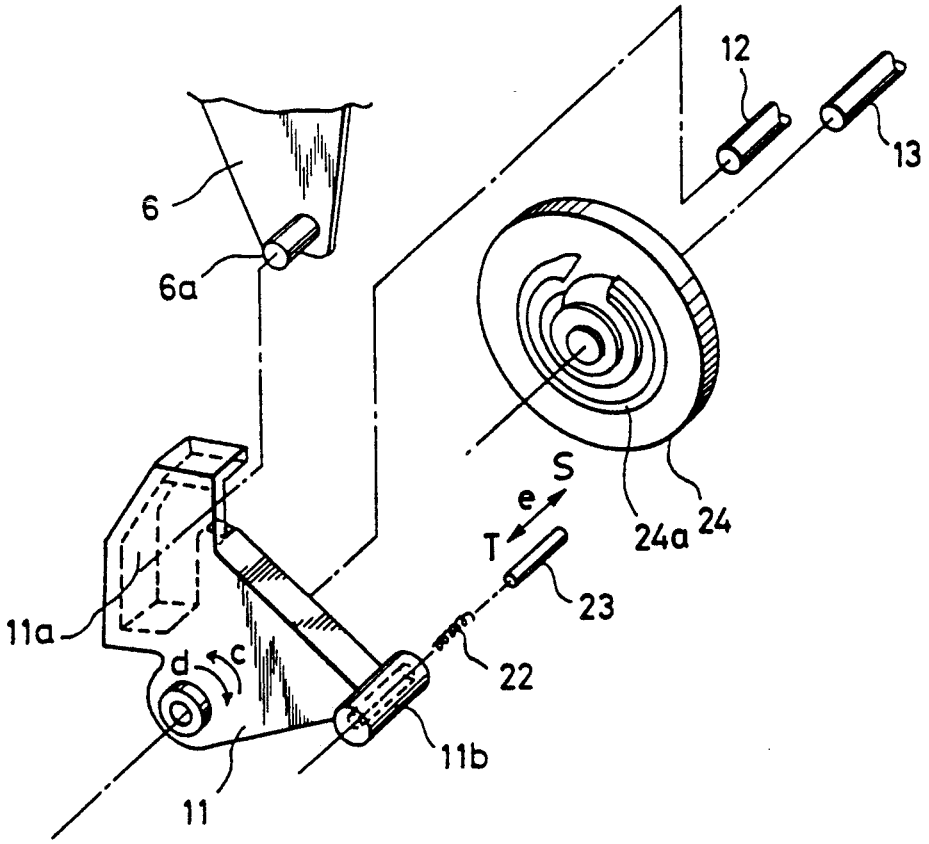
Figures 1, 8:
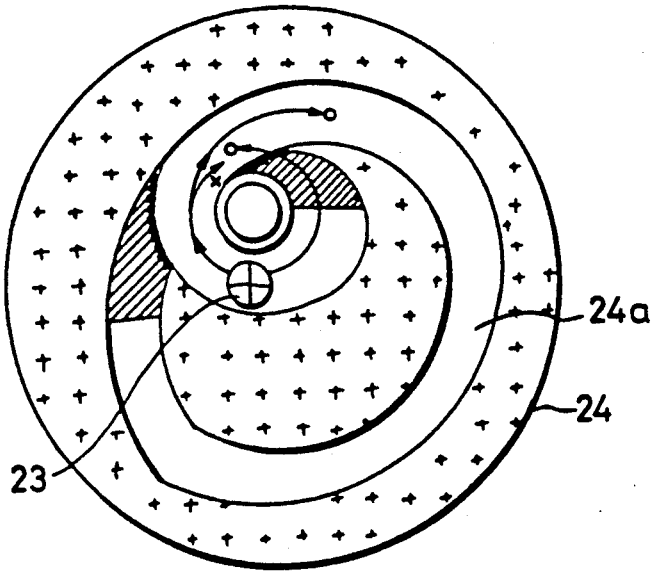
Figures 2, 8:
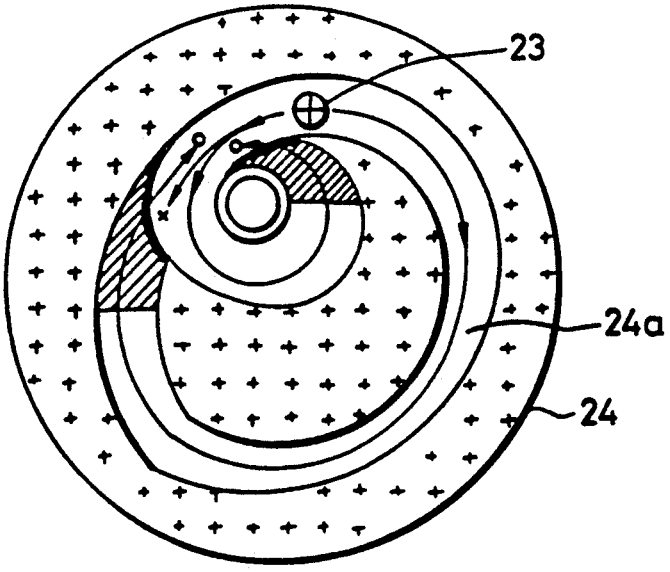
Figures 1, 9:
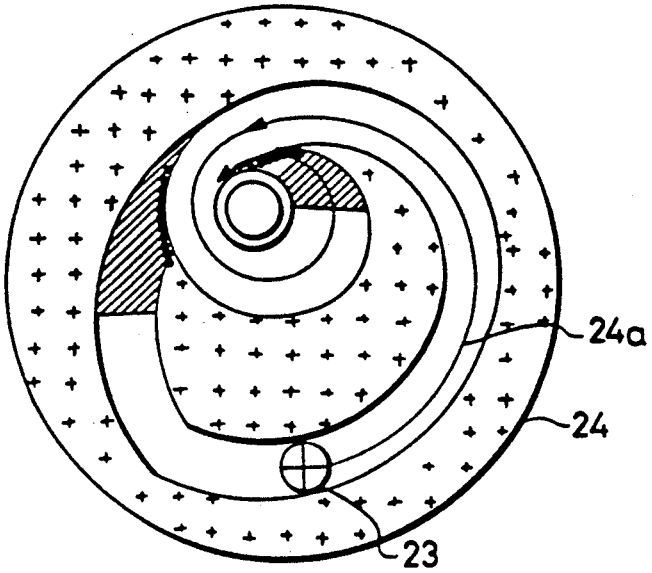
Figures 2, 9:
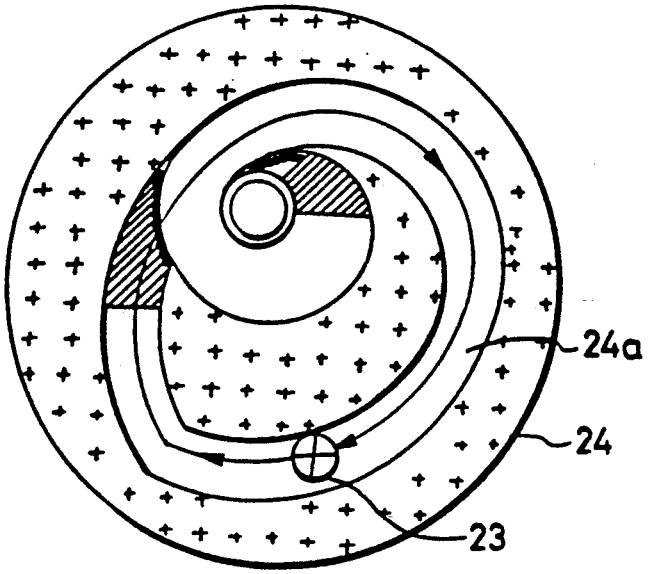
Figures 3, 9:
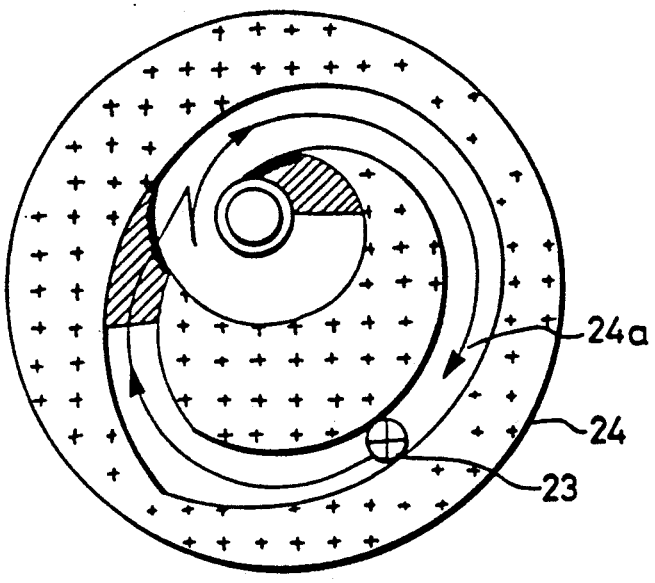
Figures 4, 9:
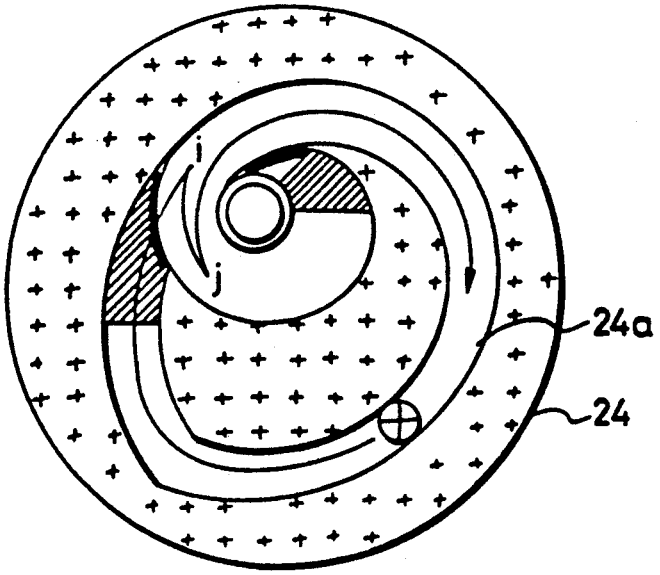
Figure 12:
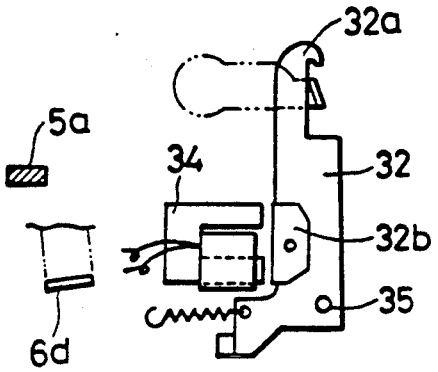
FIGS. 12 and 13 are schematic views showing the function of a switching solenoid.
Figure 13:
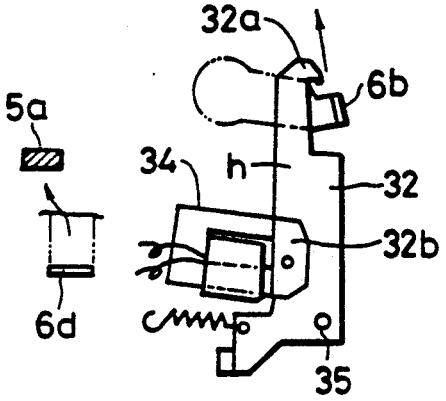
Figure 14:
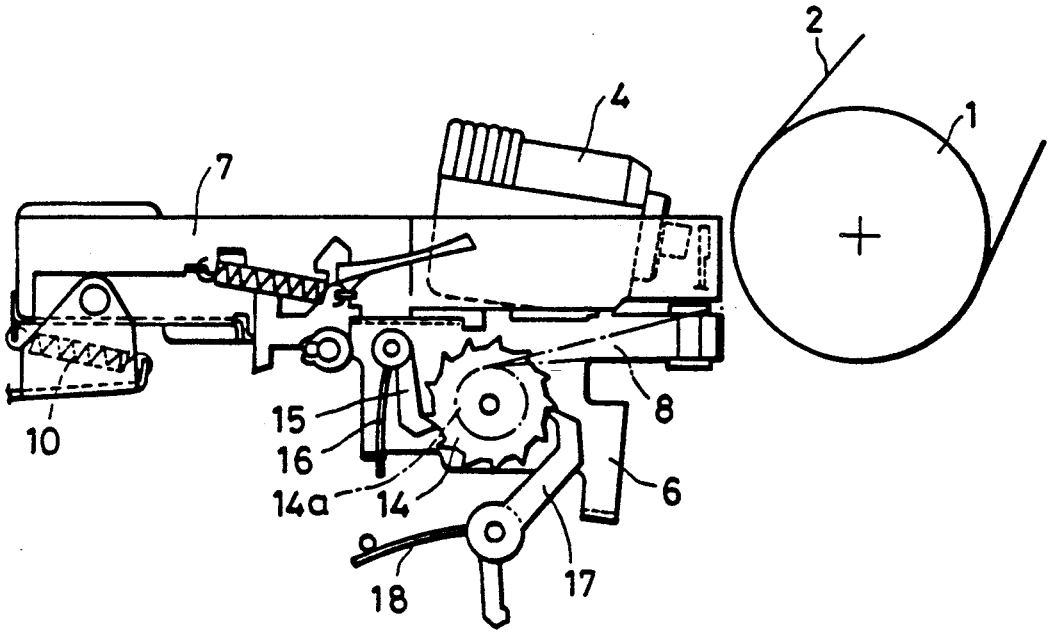
FIGS. 14 to 16 are schematic views showing the opposite side of a ribbon frame.
Figure 15:
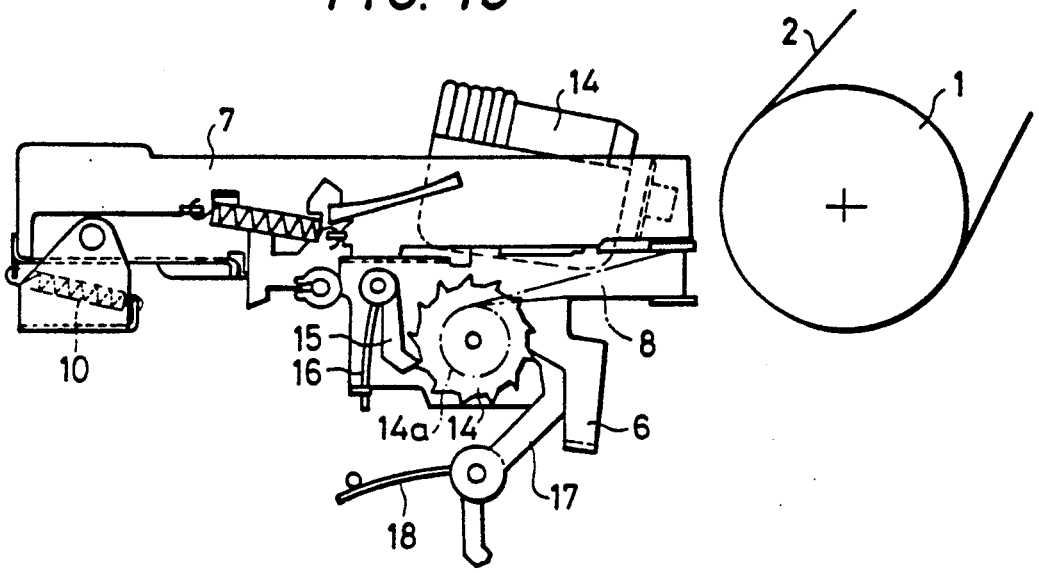
Figure 16:
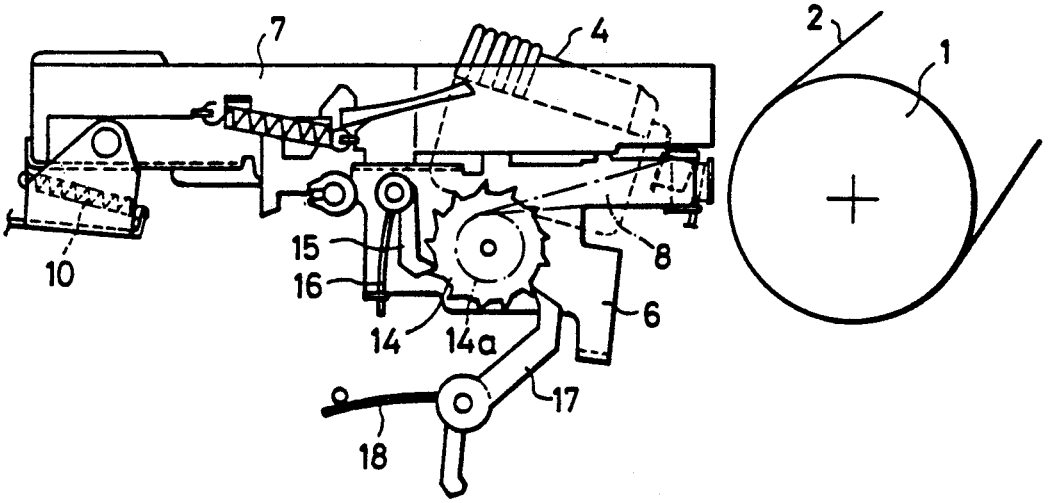

In the following there will be given a detailed explanation on the output device B. FIG. 2 is a perspective view of the carriage B shown in FIG. 1, while FIG. 3 is a lateral view seen from a direction A in FIG. 2, and FIGS. 4 to 6 are schematic views of a ribbon lifting mechanism respectively showing a ribbon down state, a ribbon lifted state for printing and a ribbon lifted state for correction. FIGS. 7 to 9 are schematic views showing the structure and function of a cam gear and a cam lever. FIGS. 10, 11-1 and 11-2 are schematic views showing the structure and function of a ribbon winding shaft, and FIGS. 12 and 13 are schematic views showing the function of a switching solenoid. Also FIGS. 14 to 16 are schematic views of a correction ribbon feeding mechanism.

As shown in FIG. 2, the output unit or carriage B is mounted on a slider 50 of a linear motor and moves in the longitudinal direction thereof for printing.

An unrepresented type-selecting motor, provided in the carriage, selects a type from a daisy-wheel type element 3, and the thus selected type is hit by a hammer 4*a* of a solenoid unit 4 for making a print on the paper 2.

A ribbon frame 6, made of a metal plate, supports exposed portions 7*a*, 8*a* of a ribbon of a printing ribbon cassette 7 and a correction ribbon 8 at vertically different positions, and is rendered rotatable, as indicated by arrows a, b in FIG. 3, about a fulcrum 9 formed on a carriage frame 5.

Figure 4:
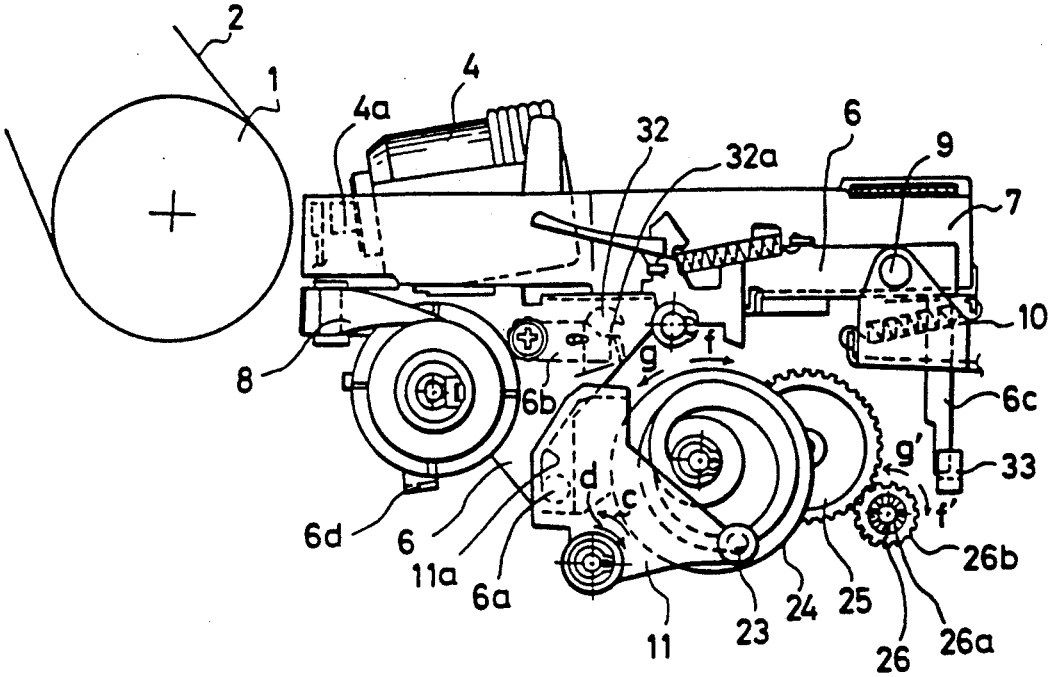
FIGS. 4 to 6 are schematic views showing the function of a ribbon lifting mechanism shown in FIG. 3.

A spring 10 applies a biasing force for lifting the frame 6 in the direction of arrow a, but the ribbon cassette is maintained in a ribbon down position lower than the printing position, since a roller 6a fixed in an extended part of the ribbon frame 6 as shown in FIG. 4 is retained by a roller guide wall 11a of a cam lever 11. As shown in FIG. 7, the cam lever 11 is provided with a cylindrical part 11b incorporating therein a cam pin spring 22 and a cam pin 23. By means of the cam pin spring 22, the cam pin 23 is pressed into a cam groove 24a of a cam gear 24. The cam lever 11 is rotatably supported on a shaft 12 projecting from the carriage frame 5.

As will be apparent from the above-explained structure, the ribbon frame 6 is rendered rotatable about the fulcrum 9, and is normally biased upwards by the spring 10, but the upward motion is prohibited as the roller 6a engages with the roller guide wall 11a of the cam lever 11. The guide lever 11 is freely rotatable on the shaft 12, and the rotational position of the guide lever 11 finally determines the stop position of the ribbon frame 6. The rotational position is determined by the rotational position of the cam gear 24.

The cam gear 24 is rotatably supported on a shaft 13 projecting from the carriage frame 5, and is provided with a cam groove 24a of varying depth. The cam pin 23 engages with the cam groove 24a, and follows the depth thereof by extending and retracting in directions S and T shown in FIG. 7 through the function of the spring 22, thus tracing the groove in one direction, wherein the tracing in the groove 24a is always defined by rotation of the cam lever 11 about the shaft 12.

Figures 2, 11:
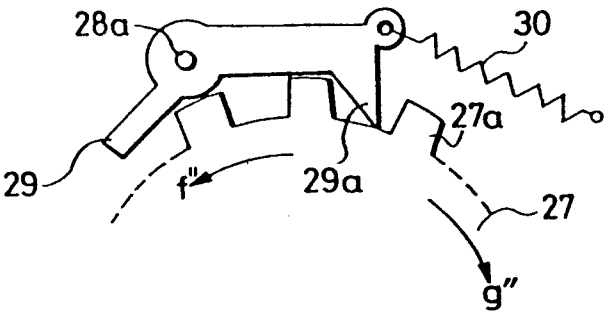
Figures 1, 11:
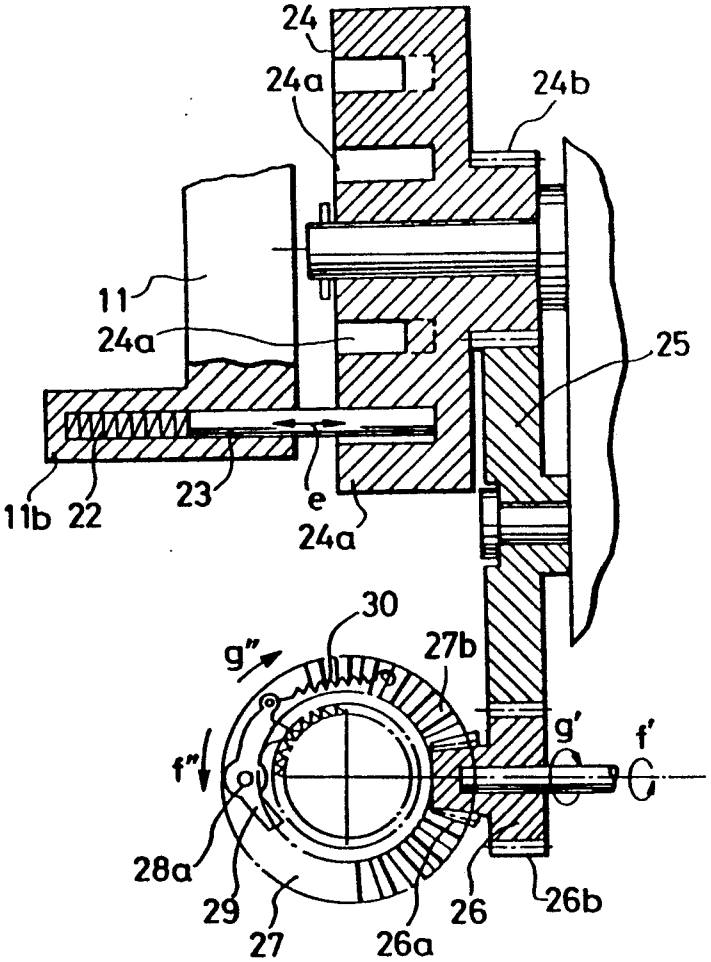

In the following there will be given a further explanation of the cam gear 24, while making reference to FIGS. 8-1, 8-2, 9-1, 9-2, 9-3 and 9-4 showing the mode of rotation thereof and FIG. 11-1 showing the detailed structure thereof. At first referring to FIG. 8-1, hatched areas indicate areas raised from the plane of the drawing, and symbols "." indicate a shoulder raised at the hatched area side. Reference numeral 24a indicates a groove while symbols "+" define areas higher than the groove. As shown in FIGS. 7 and 11-1, the cam pin traces the groove 24a while extending or receding in a direction e. Thus, the cam pin located at 23 in FIG. 8-1 can move along an arrow marked with "o" only. The cam pin 23, sliding with the spring 22 cannot pass a shoulder from a deeper part to a shallower part, but can pass a shoulder from a shallower part to a deeper part or move along a gradual change of depth.

Also in FIG. 8-2, the cam pin can move along an arrow marked with "o" for the same reason. Thus, in the case a pinion gear 26 is rotated in a direction f' shown in FIG. 4 to rotate the cam gear in a direction f, the cam gear moves as shown in FIG. 9-1. On the other hand, in case the pinion gear is rotated in a direction g' to rotate the cam gear in a direction g, the pin moves as shown in FIG. 9-2.

In general, the cam pin 23 moves along a groove of larger diameter shown in FIGS. 8-1 to 9-2 in the clockwise movement and along a groove of smaller diameter in the counterclockwise movement, and combinations of these movements can achieve various control as will be explained later. (Winding mechanism for printing ribbon)

Figure 10:
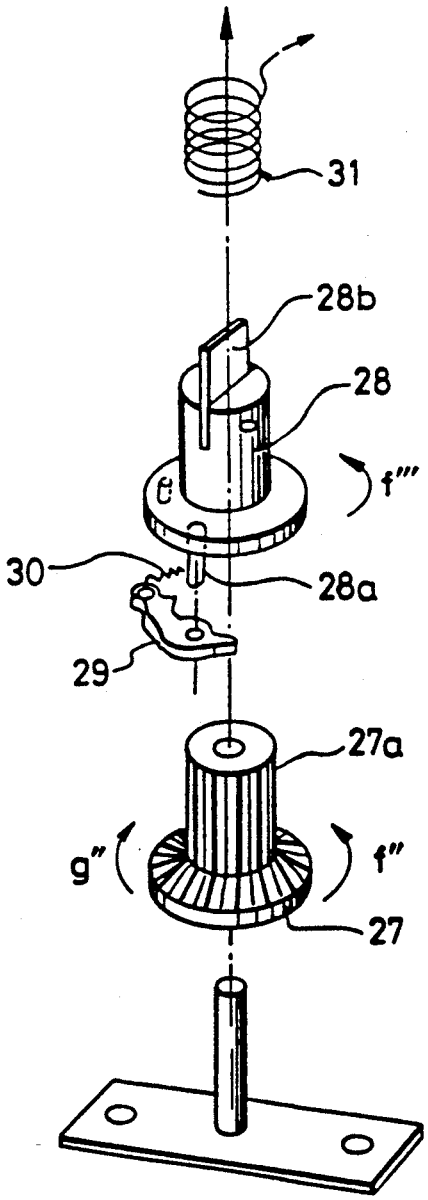

In the following there will be explained a winding mechanism for the printing ribbon. In FIG. 11-1, the pinion gear 26 is provided with a bevel gear 26a and a flat gear 26b for driving said cam gear 24. FIG. 10 shows the structure of a ribbon winding shaft driven by the bevel gear 26a. The bevel gear 26a shown in FIG. 11-1 meshes with a bevel gear 27 having ratchet teeth 27a continuously extended to 27b to drive a ribbon winding shaft 28 shown in FIG. 10. Thus, rotation of the pinion gear 26 in a direction f' shown in FIG. 4 causes rotation of the bevel gear 27 in a direction f'' shown in FIGS. 10 and 11-1. As the ratchet teeth 27a provided above the bevel gear engage with a claw 29 rotatably supported by a pin 28a of the ribbon winding shaft 28 and biased by a spring 30, rotation of the bevel gear in the direction f'' induces rotation of the shaft 28 in a direction f'''. Around the shaft 28 there is provided a clutch spring 31 to release a clutch in the rotation of the shaft in the direction f''' but to lock the shaft in the opposite rotation. Consequently, rotation of the pinion 26 in the direction f' shown in FIG. 4 causes rotation of the shaft 28 in the direction f''' whereby an engaging claw 28b, engaging with an unrepresented feed gear of the ribbon cassette, advances the ribbon. On the other hand, when the pinion rotates in the direction g' shown in FIG. 4, the bevel gear 27 rotates in a direction g'' but the shaft is prevented from rotation by the clutch spring 31. In this state the ratchet teeth 27a are disengaged from the claw 29 to disconnect the shaft 28 from the gear 27, so that the ribbon is not advanced. FIG. 11-2 shows the form of engaging portion 29a of the claw 29 engaging with the ratchet teeth 27a and the relation with the direction of rotation of the bevel gear 27. When the gear is rotated in the direction f'', the left-hand end of a tooth 27a engages with the right-hand end of the engaging portion 29a to advance the ribbon. In the opposite rotation, the ribbon winding shaft is not rotated since a left-sided slanted face of the engaging portion 29a slides over the tooth 27a. The spring 30 biases the claw 29 toward the center of the bevel gear, and the engaging force between the engaging portion 29a and the teeth 27a is determined by the clutch spring 31 and spring 30.

Printing operation with correctable ribbon

In the following there will be explained the printing operation with a correctable (erasable) ribbon. When the cam is rotated in the direction f from the position shown in FIG. 4, the ribbon is shifted from the aforementioned down state to a lifted state shown in FIG. 5, by means of the function of the cam lever and roller 6a, while the ribbon is advanced by the aforementioned engaging claw 28b. The lifted position of the ribbon is determined by the engagement of a lift latch 6b provided in the ribbon frame 6 and an engaging portion 32a of a switching lever 32. Immediately thereafter the hammer 4 is activated to perform a printing operation, and subsequently the ribbon returns to the down state shown in FIG. 4. In this operation the pinion 26 shown in FIGS. 11-1 and 5 is rotated in the direction g' to lower the ribbon frame 6 against the function of the spring 10, without advancing the ribbon. As explained before, in the rotation of the pinion 26 in the direction g', the claw 29 is disengaged from the gear 27 as shown in FIG. 11-2 so that the ribbon winding shaft isn to rotated. When the ribbon frame 6 is depressed as explained above, a down sensor 33, such as a limiter, is covered by a shield plate 6c provided on the ribbon frame 6, whereby the downward movement is terminated to restore the down state shown in FIG. 4.

In the case of a continuous printing operation, the cam pin 23 continues to rotate clockwise as shown in FIG. 9-1, with corresponding ribbon advancement since the rotation corresponds to the direction f shown in FIG. 4, and the ribbon frame is maintained at the lifted position during the operation.

Correcting Operation

In the following there will be explained a correcting operation. FIGS. 12 and 13 illustrate the switching lever 32 and a solenoid activating the same. In response to an instruction for correction entered from the keyboard 100, the switching solenoid 34 attracts a chip 32*b* fixed on the switching lever 32 as shown in FIG. 13, thus rotating the lever 32 around a shaft 35 in a direction h. In this state the cam is rotated in the direction g shown in FIG. 4 to lift the printing ribbon without advancement, whereby the clutch lift 6*b* does not engage with the engaging portion 32*a* of the lever and the ribbon frame is lifted until a stopper portion 6*d* thereof meets a final stopper 5*a* provided on the carriage frame. Thus the correction ribbon 8 is lifted to the printing position (FIG. 6). The hammer 4 is activated in this state to correct a mistyped print, and the ribbon is then lowered to the down position shown in FIG. 4. In this operation, the cam is rotated first in the direction g to guide the cam pin 23 through the shoulder portion of the groove and is then slightly reversed in the direction f to guide the cam pin 23 securely to the maximum lift position of the cam, as shown in FIG. 9-3. It is however possible also to dispense with the reverse rotation.

FIGS. 14 to 16 are schematic lateral views of the ribbon frame seen from the opposite side, principally illustrating an advancing mechanism for the correction ribbon, and respectively show a down state, a lifted printing state and a correcting state, corresponding to the states shown in FIGS. 4 to 6.

A winding ratchet wheel 14 for winding the correction ribbon 8 on a shaft 14*a* is rotatably supported on the ribbon frame 6. A ratchet 15 engages, by means of a plastic spring 16, with the ratchet wheel 14 to prevent reverse rotation thereof. A feed claw 17 is rotatably supported on the carriage frame 5 and engages with the ratchet wheel 14 by means of a plastic spring 18.

In the above-explained structure, the ratchet wheel 14 is rotated by a tooth to advance the correction ribbon by one character, in the course of movement of the ribbon frame from the down position (FIG. 14) through the printing position (FIG. 15) to the stand-by position (FIG. 16) and finally to the down position (FIG. 14).

Printing operation with multi-use ribbon cassette

A multi-use ribbon, allowing plural prints in the same position, needs less advancement compared with the correctable ribbon. Consequently the ribbon will be wasted in the case of single printing operation if the multi-use ribbon is controlled in the same manner as the aforementioned correctable ribbon.

Consequently, as in the aforementioned print-correcting operation, the cam is rotated in the direction g shown in FIG. 4 to lift the ribbon frame without the ribbon advancement. In this state the ribbon is lifted only to the printing position since the switching solenoid 34 is not energized. The movement of the cam pin in this state is shown in FIG. 9 - 4. The lifting operation of the ribbon by the cam 24 is completed when the cam pin 23 reaches a point i, and the cam 24 is then rotated in the direction f by a predetermined amount to bring the cam pin 23 from the point i to a point j. In this operation the multi-use ribbon is wound by a predetermined amount corresponding to the rotation in the direction f. Thereafter the cam 24 is rotated again in the direction g to return the ribbon to the down position without ribbon advancement. In the case of a continuous printing operation, the cam pin 23 circulates the maximum lift position of the cam, in the same manner as in the continuous printing operation with the correctable ribbon.

In the following there will be explained driving circuits and control sequences for the ribbon motor, switching solenoid, hammer, linear stepping motor, wheel motor and down sensor.

Figure 17:
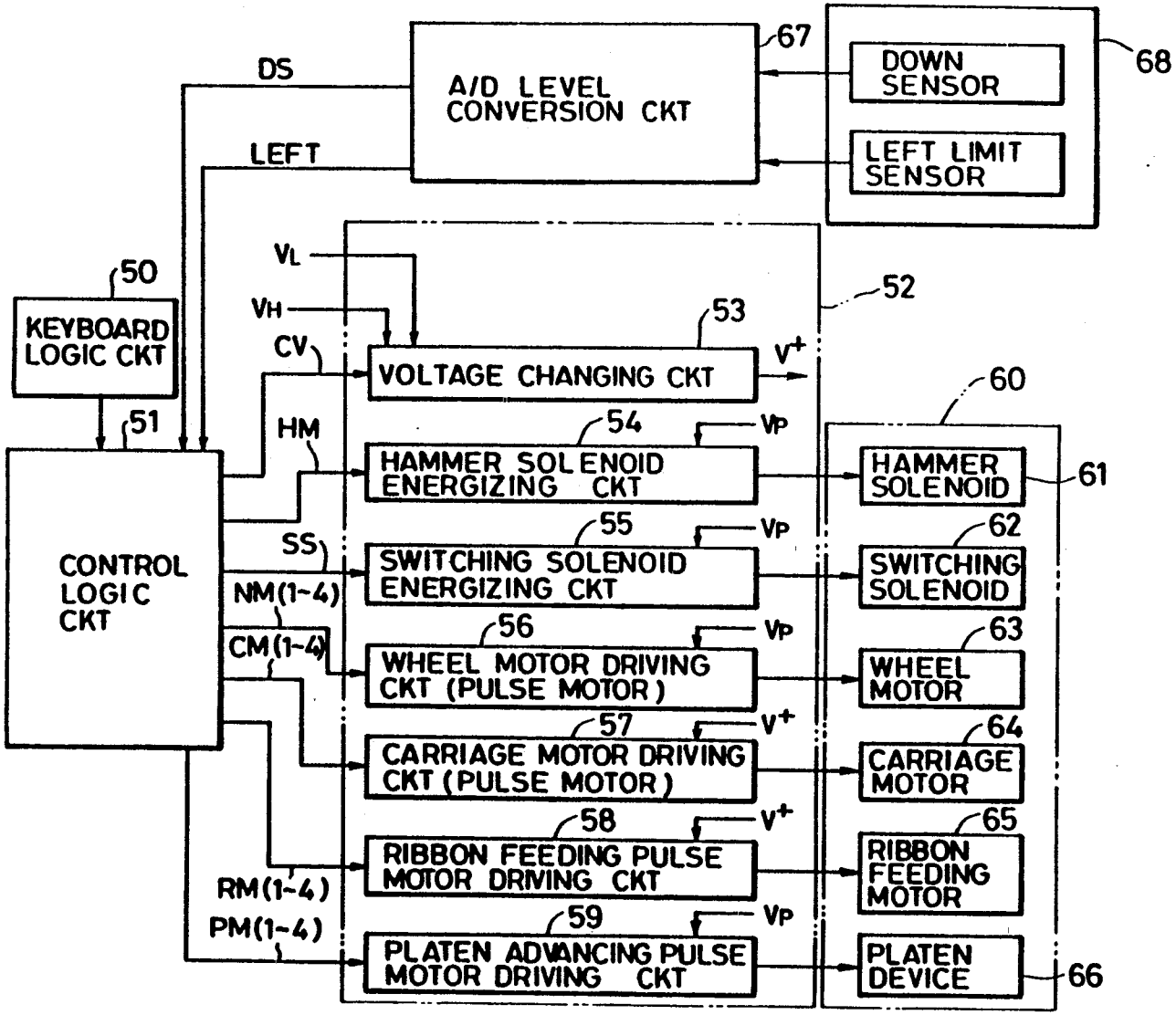
FIG. 17 is a circuit diagram of a control circuit of an electronic typewriter.

FIG. 17 is a circuit diagram of a control circuit of an electronic typewriter embodying the present invention, wherein a control logic circuit 51, controlled by input signals from a keyboard logic circuit 50, supplies control signals DS, LEFT, $V_L V_H$, CV, FM, SS, WM, CM, RM, PM to various loads in driving circuit 60, after suitable amplification by unit driving circuit 53–59 in driving circuit 52. The loads include the hammer solenoid 61, switching solenoid 62, wheel motor 63, carriage motor 64, ribbon motor 65, platen device 66 etc. which are driven by the key actuations in the keyboard 100 and the above-mentioned control signals. Signals from sensors 68, including the down sensor and left limit sensor, are digitized in an analog-to-digital level converting circuit and are supplied to the control logic circuit 51 through signal lines DS, LEFT.

Figure 18:
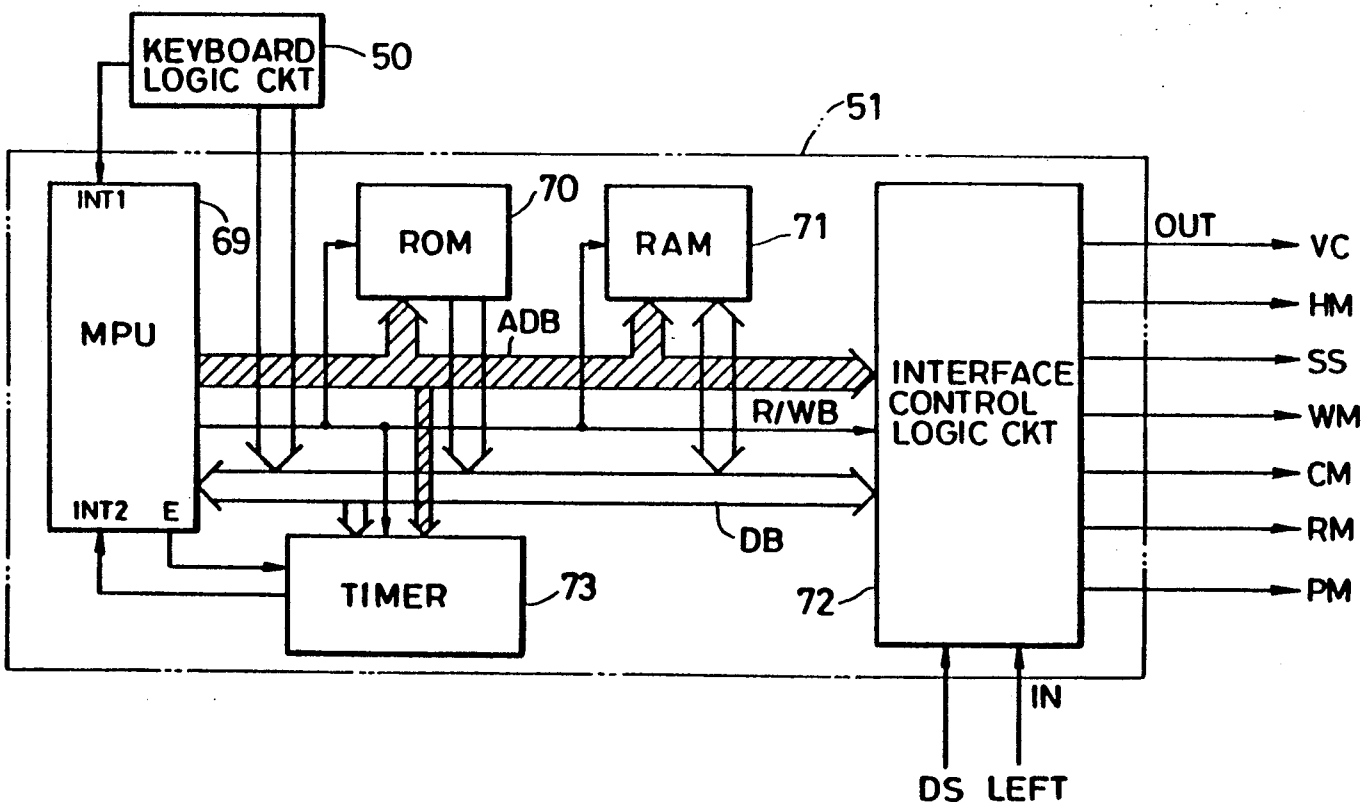
FIG. 18 is a detailed block diagram of a control logic circuit and a keyboard logic circuit.

FIG. 18 is a detailed block diagram of the control logic circuit 51 and keyboard logic circuit 50.

In the control logic circuit 51 shown in FIG. 18, there is provided a micro processing unit (MPU) 69 which performs control in response to the input signals from the keyboard logic circuit 50 and which transmits and receives microinstructions and data to and from a read-only memory (ROM) 70, a random access memory (RAM) 71, an interface control logic circuit 72, a timer 73 and the keyboard through a common data bus DB in cooperation with an address bus ADB and a read-write bus R/WB. In such structure, the microprocessing unit (MPU) 69 executes the control process according to microinstructions stored in advance in the read-only memory 70 or in the random access memory 71. The timer 73 increases the content thereof according to code signals indicating time intervals supplied from the MPU through,. the data bus DB, and, after the lapse of a predetermined time, requests an interruption to the above-mentioned program to the MPU through a line LNT2. Also the keyboard logic circuit 50 requests, in response to a key actuation in the keyboard 100 and through an interruption signal line INT1, an interruption process according to a program stored in the RAM or ROM. Simultaneously microcoded key information, required for the interruption process, is supplied to the data bus DB.

On the other hand, the interface control logic circuit 72 latches microencoded drive signals and amplifies the control signals CV, HMSS, WM(1-4), CM(1-4), RM(1-4), PM(1-4) to the levels suitable for driving various loads.

Figure 19:
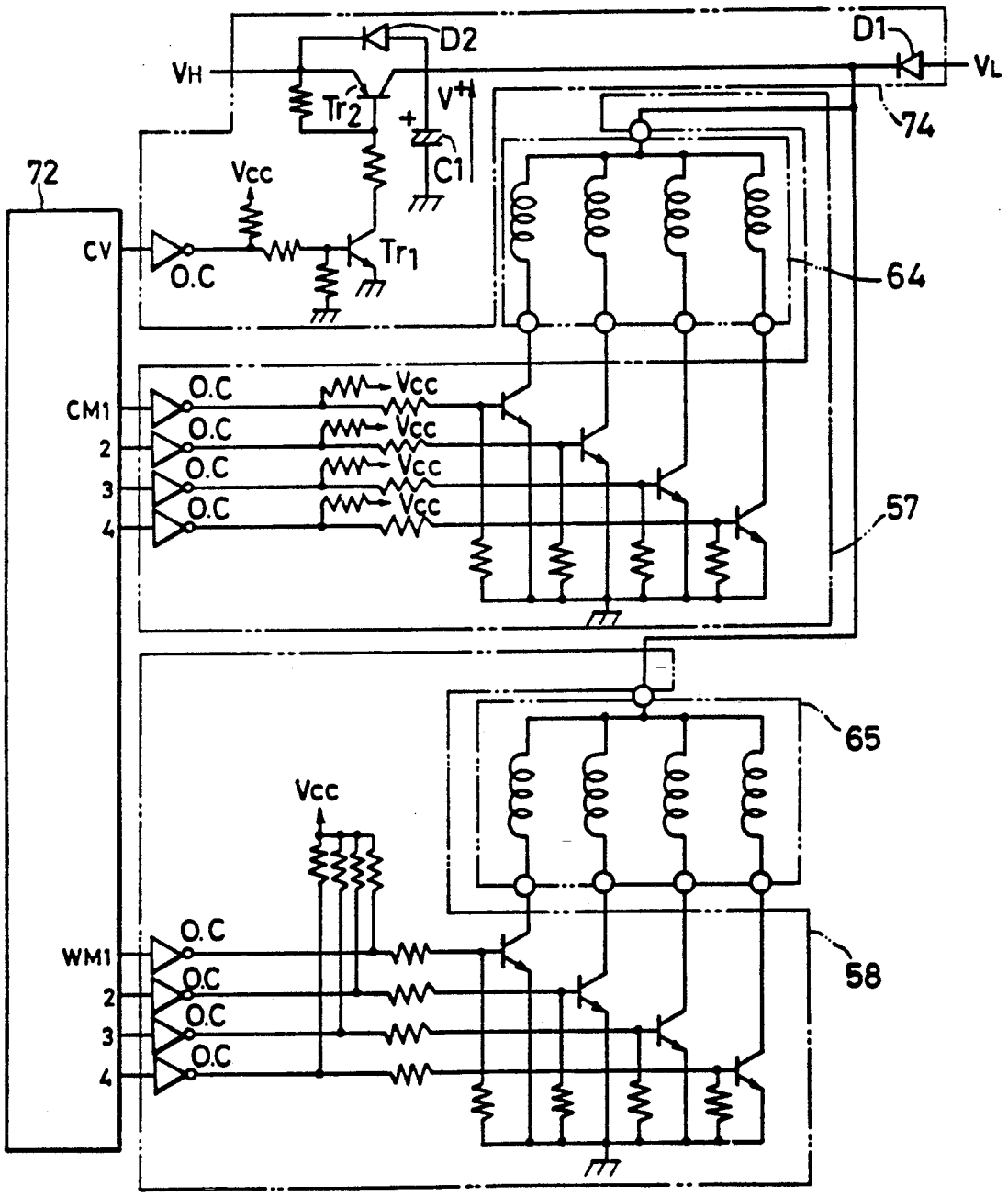
FIG. 19 is a detailed circuit diagram of a voltage switching circuit and a driving circuit.

FIG. 19 shows the details of the driving circuit 52 shown in FIG. 17, including, for example, the voltage switching circuit 53. A voltage selecting circuit 74 selects either of two voltages VH, VL according to a signal CV from the interface control logic circuit, for use as a common power supply voltage for driving the carriage motor and the ribbon motor. In the case where the signal CV is at an L-level, an open-collector inverter, employed for lever conversion, provides an H-level output signal to activate transistors Tr1, Tr2, whereby a high voltage $V_H$ is supplied to a point V+. On the other hand, in the case where the signal CV is at an H-level, the open-collector inverter provides an L-level output signal to turn off the transistors Tr1, Tr2, whereby a low voltage VL is supplied to the point V+ through a diode D1. A diode D2 protects the transistor Tr2 in the case of V+>VH.

Consequently efficient motor driving is possible by employing a high voltage in the case where a high torque is required tolerating colerating a low duty ratio, or a low voltage when a low torque is enough, but heat generation of the motor is to be considered because of a high frequency of use.

Figure 20:
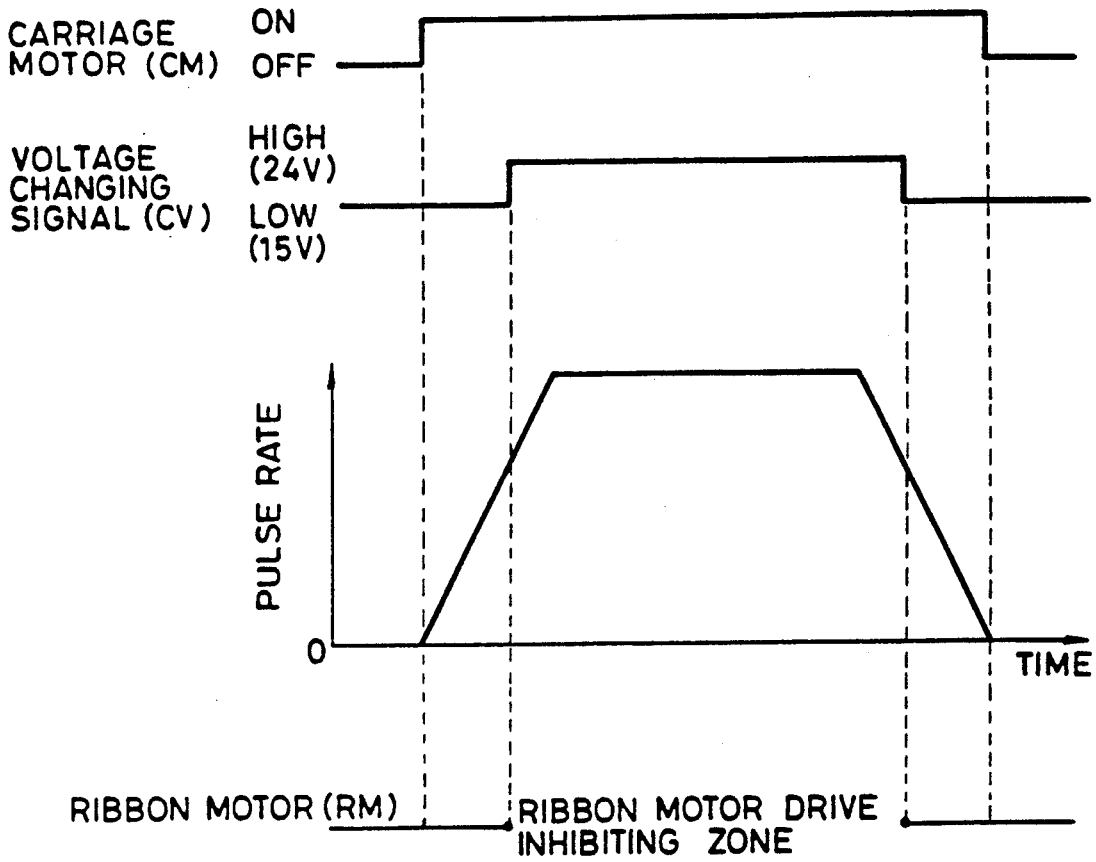
FIG. 20 is a timing chart for motor protection.

In the case where the carriage motor is driven with the H-level for a prolonged period, the ribbon motor is also energized with the H-level. However, if such drive leads to damage in the ribbon motor because of the duty ratio of the power supply, the ribbon motor may be appropriately deactivated by the MPU 72. Such mode of drive is shown in FIG. 20, in which the ribbon motor is deactivated by the MPU while the carriage motor is driven by the H-level signal. The ribbon motor is energized with the L-level signal to advance the ribbon while the carriage motor is driven with the L-level signal.

Figure 21:
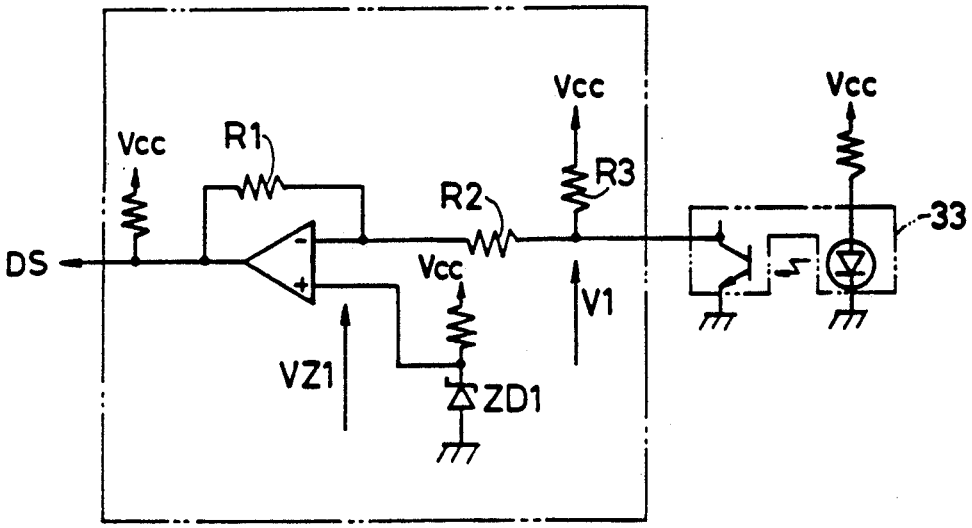
FIG. 21 is a circuit of a down detector and a left-end detector.

FIG. 21 is a circuit diagram of the down detector and left end detector 68 and the analog-to-digital level converting circuit 67. Since the circuit structure is the same, explanation will be given only to the down detector 33 in the following. In the down detector, a constant current is continuously given to a light-emitting diode (LED) of an interrupter, while a voltage Vcc is supplied through a resistor R3 to the collector as a phototransistor. Thus the collector potential V1 of the phototransistor is determined by the position of a shield positioned between the light-emitting diode and the phototransistor. A comparator compares the potential V1 with a reference voltage VZ1 determined by a Zener diode ZD1, and provides an output signal DS of L-level or H-level respectively when V1>VZ1 or V1<VZ1. The reference voltage VZ1 is selected between a potential V1 in the case of complete shielding and another potential V1 in the case of absence of shielding, and the comparator 1 is provided with a so-called hysteresis circuit composed of resistors R1 and R2, in order to stabilize the level of the output signal DS, even when the V1 and VZ1 are approximately equal.

Figures 1, 22:
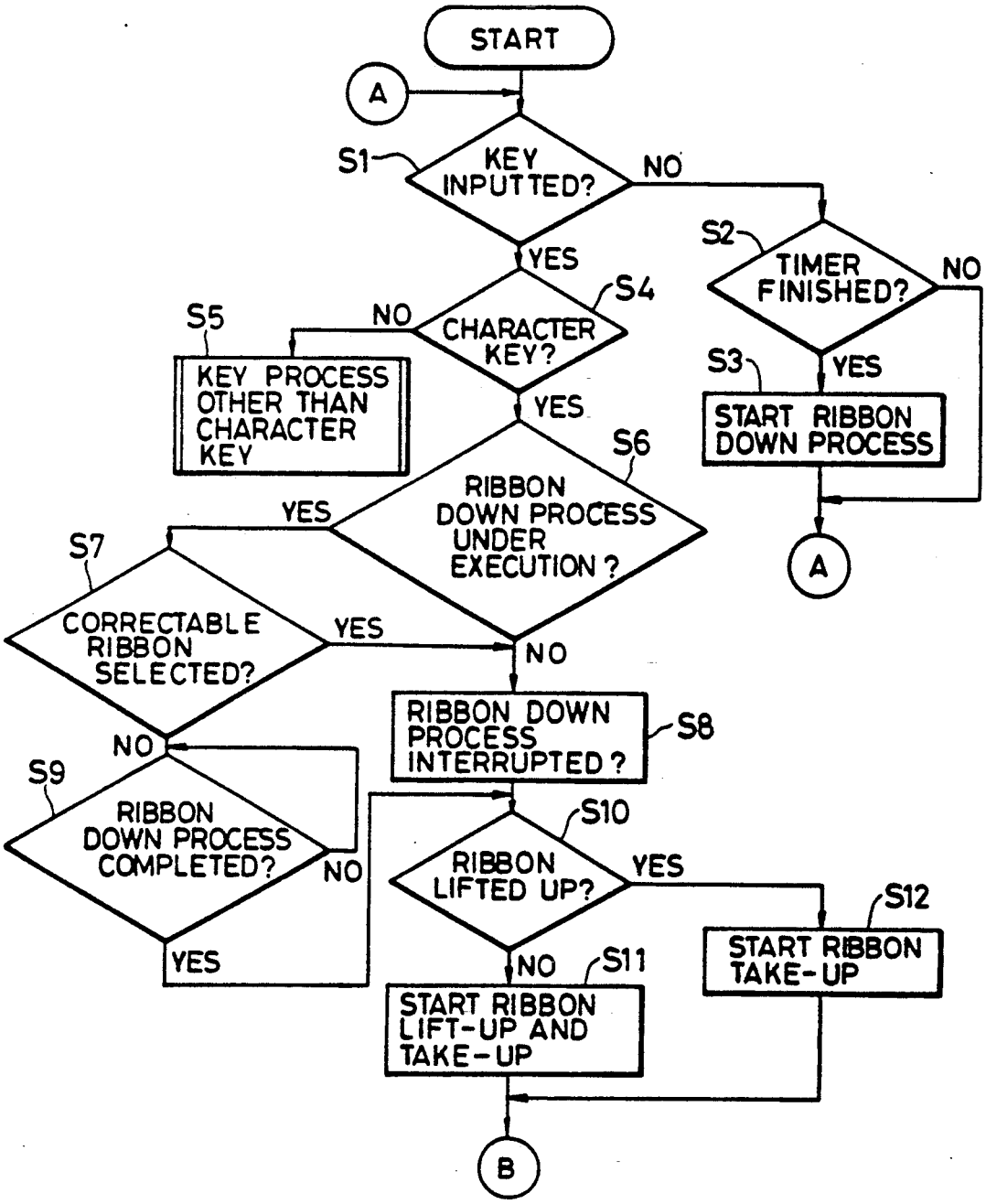
Figures 2, 22:
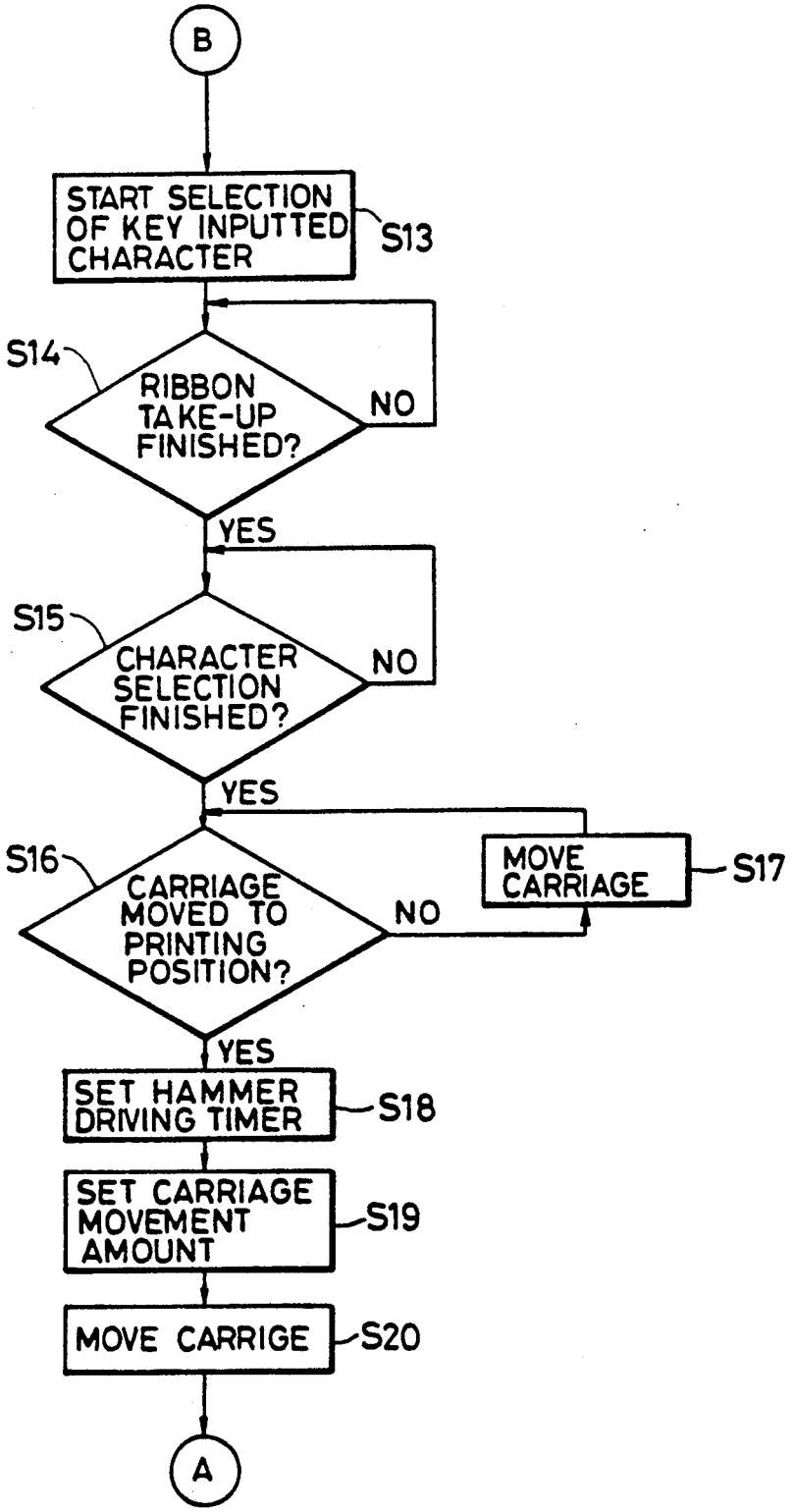

FIG. 22 shows a flow chart for the output sequence executed by the MPU. Steps S1–S3 identify the presence of key entry, and step S2 identifies the time since the preceding printing operation to lower the ribbon from the printing position according to the time. In the case where a key entry is identified in step S1, a step S4 identifies whether the key is a character key, and, if not, the program proceeds to a step S5 to be explained later. In the case where step S4 identifies the actuation of a character key, the program proceeds to a step S6 to identify whether or not a ribbon lowering process is in progress. If so, a step S7 identifies the loaded ribbon, and, if it is a correctable ribbon, the program proceeds to a step S8 to interrupt the ribbon lowering operation. On the other hand, in the case where the step S7 idenfifies a multi-use ribbon, the program proceeds to a step S10 after confirming the completion of the ribbon lowering process in a step S9. Steps S10, S11, S12, S13, S14 and S15 advance the ribbon and select the key-entered character, while the ribbon is maintained in the lifted state.

Subsequently, steps S16 and S17 displace the carriage to the printing position, and a step S18 energizes the hammer to perform a printing operation, and the timer is set for controlling a next key entry and the ribbon lowering control. Then succeeding steps S19 and S20 set the amount of subsequent movement of the carriage, and move the carriage, and the program returns to point A.

Figure 23:
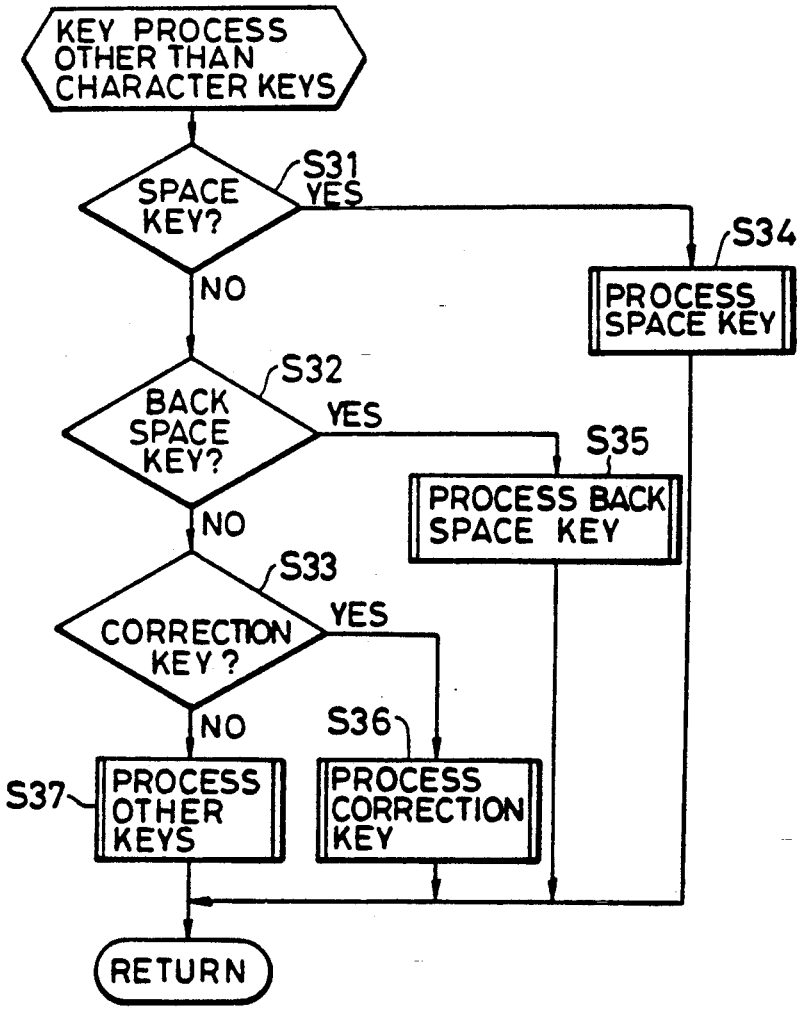
FIG. 23 is a flow chart for key entry process for other than character keys.

FIG. 23 shows a flow chart for non-character key process shown in step S5 in FIG. 22. At first steps S31–S33 identify the actuated key and according to the result of said identification there is executed a space key process (S34), a back space key process (S35), a correction key process (S36) or a process for other keys (S37).

Figures 2, 24:
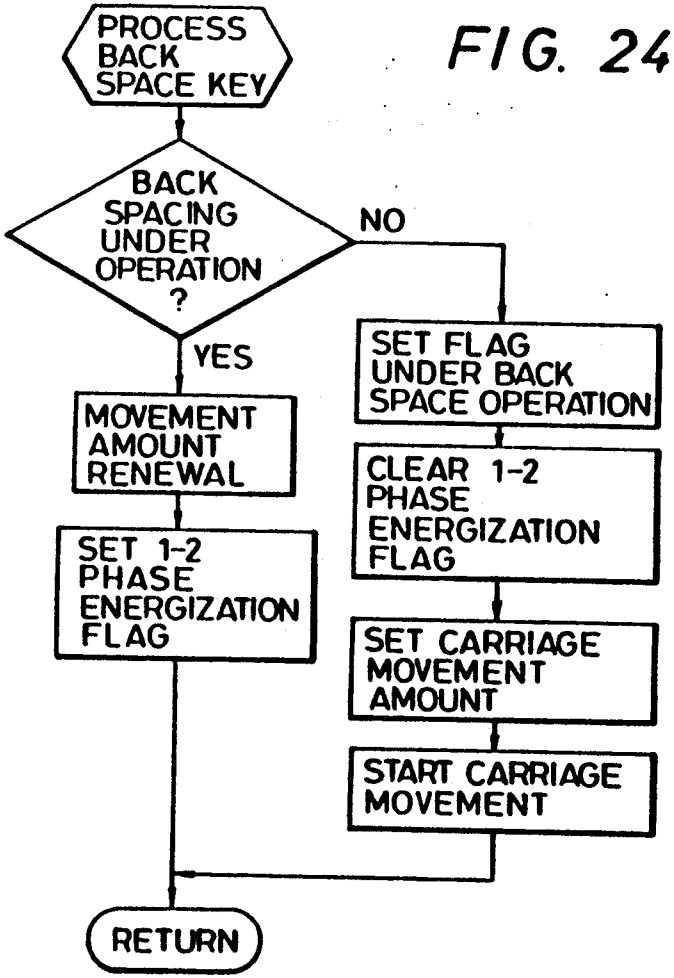
Figures 1, 24:
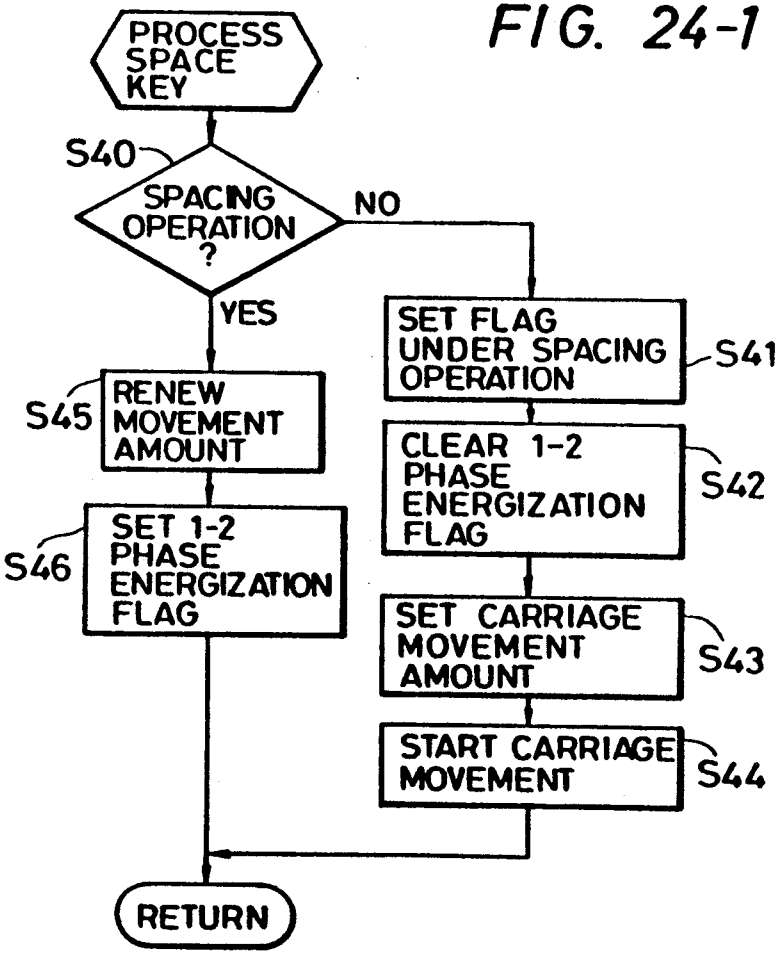

FIGS. 24-1 and 24-2 show detailed flow charts of the aforementioned space key process and back space key process shown in FIG. 23. Since these two processes are alike, there will be only explained the space key process shown in FIG. 24-1. The carriage is first driven by a 2-phase energization with a high torque, but is then driven by 1–2 phase energization for abating noise. At first a step S40 identifies whether or not a spacing operation is already in progress, i.e. in a repeat operation. In the case where the repeat operation is not in progress or in the case of a first spacing operation, the program proceeds to a step S41 to set a spacing operation flag for a next identification in the step S40. In the case of a first spacing operation, a step S42 clears a 1–2 phase drive flag in order to drive the carriage with 2-phase drive. Then steps S43 and S44 set the amount of movement of the carriage and execute the movement thereof.

On the other hand, in the case where the step S40 identifies that a spacing operation is already in progress, the program proceeds to a step S45 to renew the amount of movement, to set the 1–2 phase drive flag and to continue the spacing operation with low-noise 1–2 phase drive. Though a 4 -phase stepping motor is employed in the present embodiment for displacing the carriage, it is also possible to use other motors. A 2 -phase drive provides a high torque but is associated with large noise, while a 1–2 phase drive provides only a low torque but low noise level due to smoother rotation at the start of carriage drive.

These driving modes will not be explained in detail as they are already well known. The amount of moving space by the 2-phase drive at the start is 1/15, 1/12 or 1/10 inches according to a pitch selected by a pitch selector.

Figure 25:
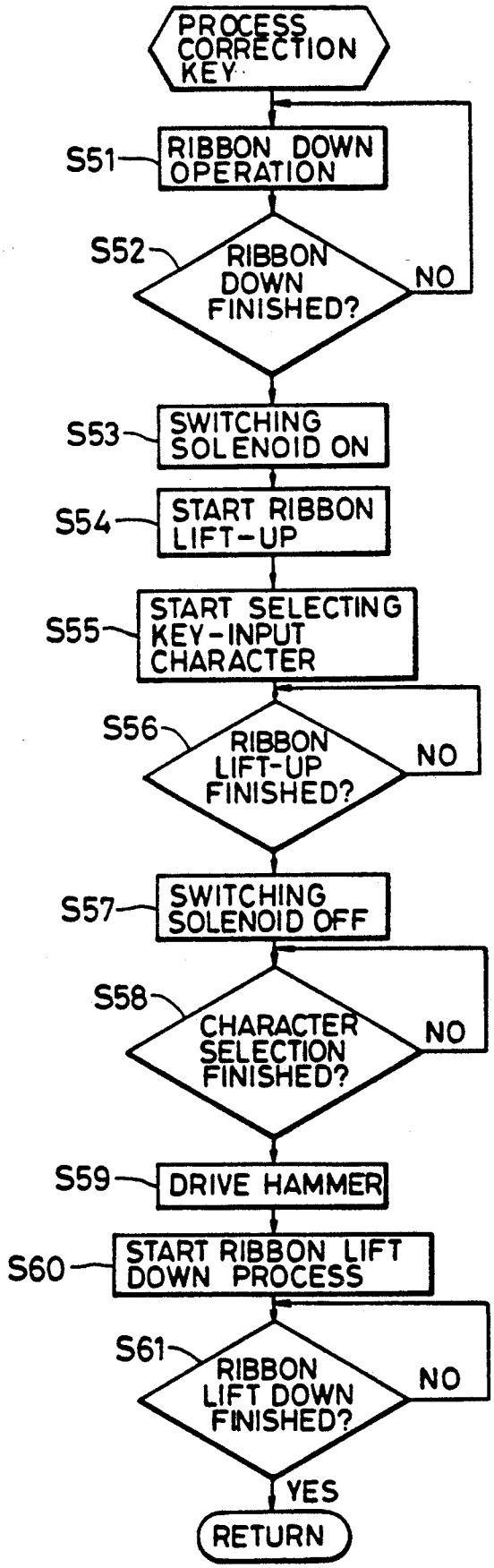
FIG. 25 is a flow chart for key entry process for a correction key.

Now reference is made to FIG. 25 for explaining a correction key process shown in FIG. 23. After the ribbon reaches the down position in steps S51 and S52, a step S53 turns on the switching solenoid explained in relation to FIGS. 12 and 13, thereby preparing the ribbon frame for lifting to the correcting position in the ensuing procedure. A step S54 then starts the lifting of the ribbon, and a step S55 selects a character to be corrected, i.e. a character of an immediately preceding key entry. If a step S56 identifies the completion of the lifting, a step S57 turns off the switching solenoid. Then, if a step S58 identifies the completion of character selection in the step S55, the program proceeds to a step S59 to activate the hammer, and steps S60 and S61 lower the ribbon. At the lowering of ribbon, it is advanced as explained before.

The above-explained wheel motor for character selection, carriage motor, motor for elevating and lowering the ribbon and ribbon advancing motor are driven by storing the pattern of energized phases in the corresponding addresses of the interface control logic circuit 72 and setting the energizing time in the timer. When the timer expires an interruption signal is supplied to the CPU through the line INT2, and the pattern and energizing time of succeeding energized phases are set in the interruption process. The above-explained procedure is thereafter repeated for a number of predetermined steps. During the above-explained process there is set a flag indicating the continuation of the process, and the flag is reset upon completion of the procedure. The flag is set in the RAM.

The pattern of the energized phases and the table of energizing time are stored in the ROM. The timer is provided therein with three timer counters, in each of which a preset value is stepwise decreased at every predetermined interval, and an interruption signal is supplied to the CPU when the content of the timer counter reaches zero. The three timer counters are used for controlling the energizing times in three motors.

The character selection of the wheel motor is achieved by the CPU which drives the wheel motor by determining the direction of rotation and the number of steps, through the comparison of the current position of the wheel and the wheel position corresponding to an entered character key, making reference to a wheel position table in the ROM.

Figure 26:
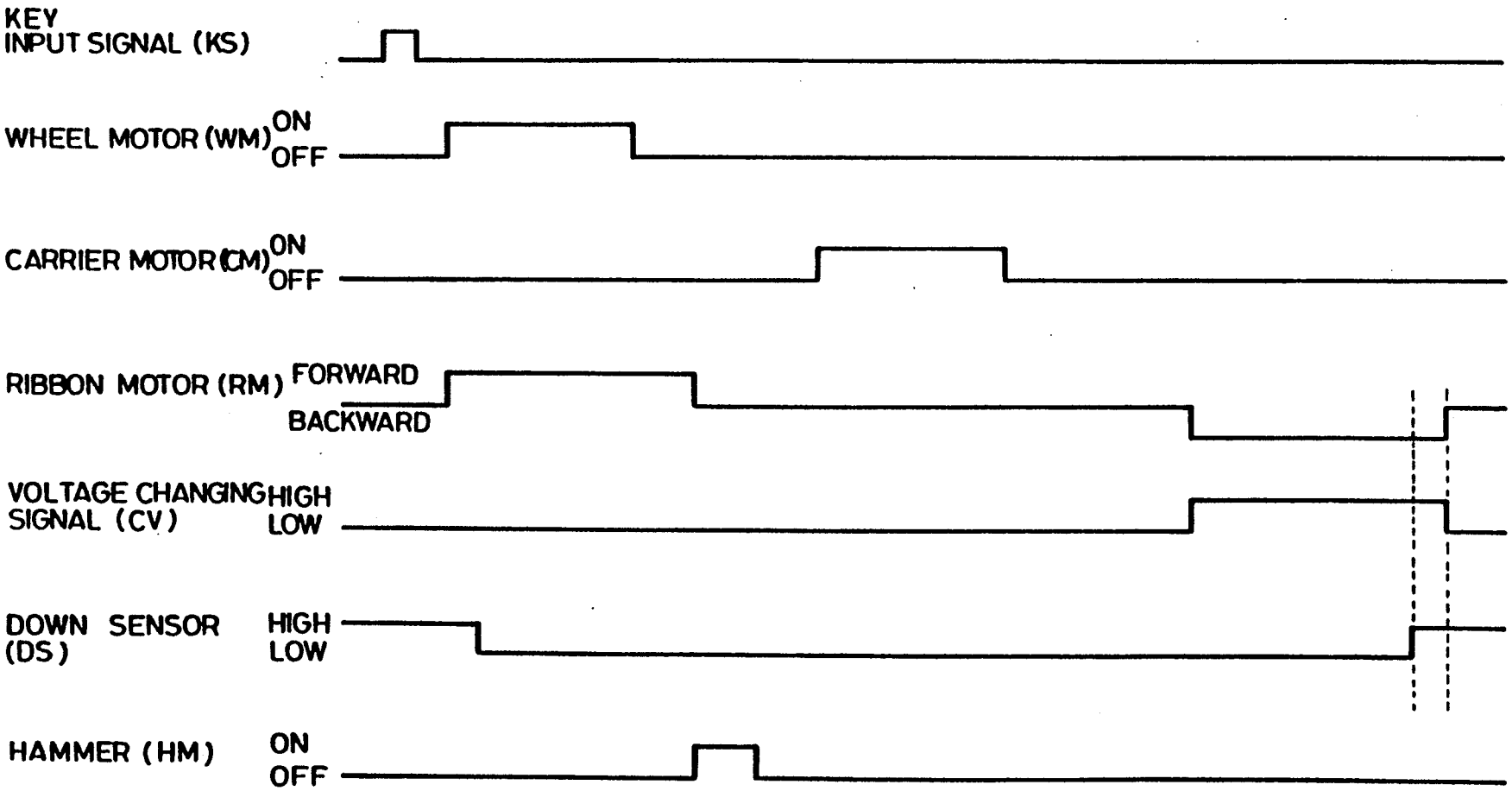
FIGS. 26 to 31 are timing charts for a printing sequence.

The above-explained printing sequence will be explained by timing charts. FIG. 26 is a timing chart showing the printing sequence in the case of single printing operation with a correctable ribbon. At first, in response to a key input signal KS, the wheel motor WM is activated to select a character corresponding to the key input. Simultaneously the ribbon motor is rotated in the forward direction f shown in FIG. 4 with a low voltage, thereby lifting the ribbon to the printing position and advancing the ribbon by a predetermined amount (see FIG. 9-1). After the ribbon advancement the hammer is energized to print a character. Thereafter the carriage motor is energized to move the carriage to a next printing position The low-level (15 V) driving voltage is employed in this state as will be apparent from the voltage switching signal. Then the ribbon motor is reversed with the high-level voltage (24 V) for lowering the ribbon, and, after the detection of the down position of the ribbon by the down sensor 33 shown in FIG. 2, the ribbon motor is further driven for a predetermined number of steps and is then turned off. A high-level signal from the down sensor indicates that the shield plate 6c shown in FIG. 2 is positioned in the limiter 33, corresponding to the down position of the ribbon.

Figure 27:
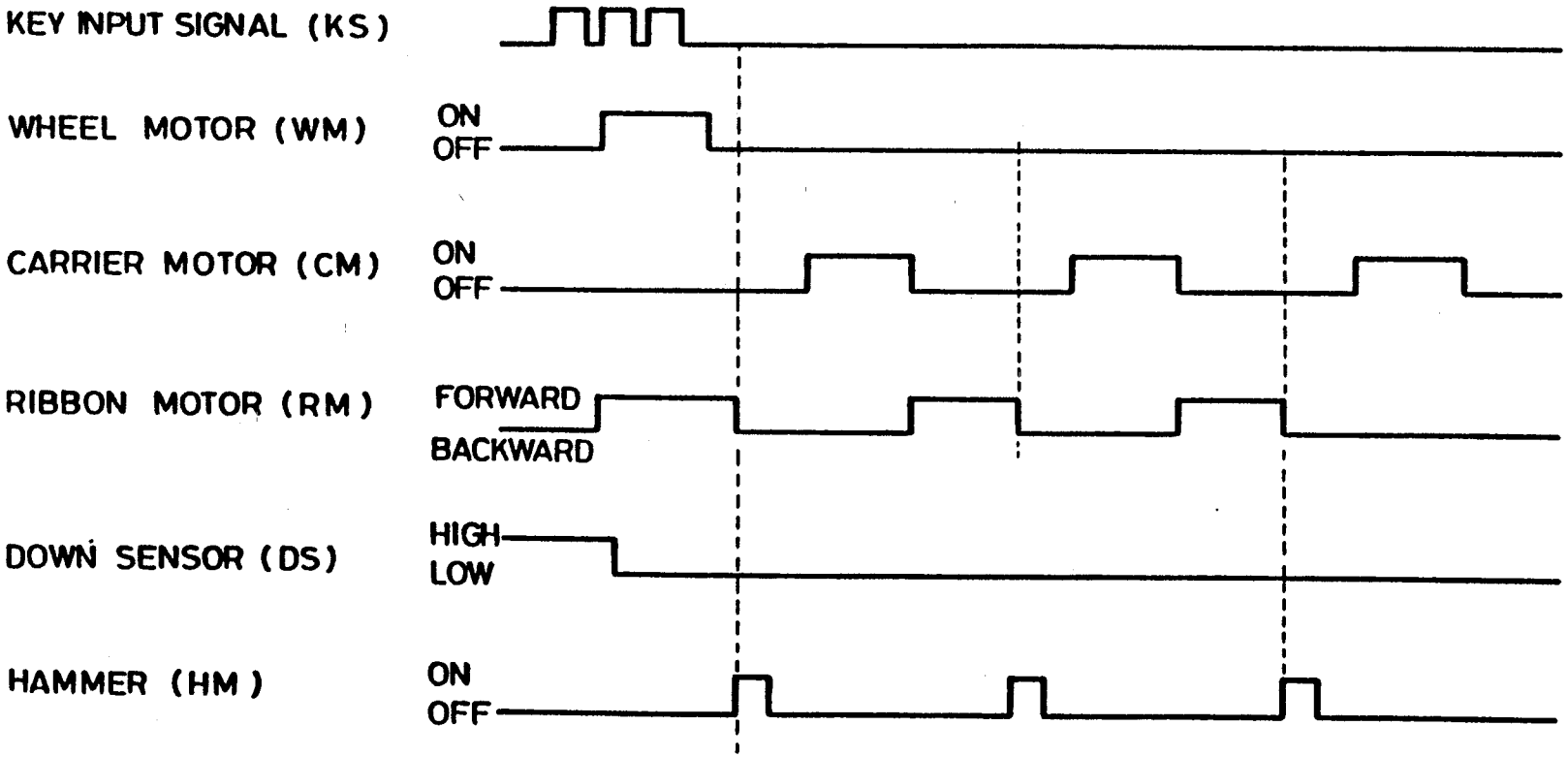

FIG. 27 is a timing chart showing the continuous printing sequence with a correctable ribbon. At first, in response to a key input signal KS, the wheel motor WH, ribbon motor RH and hammer HM are activated in the same manner as in the single printing operation. In the presence of a succeeding key input within a predetermined period, for example in the course of movement of the carriage to a succeeding printing position, a subsequent printing operation is conducted while the ribbon is maintained in the lifted position (see FIG. 9-1).

Figure 28:
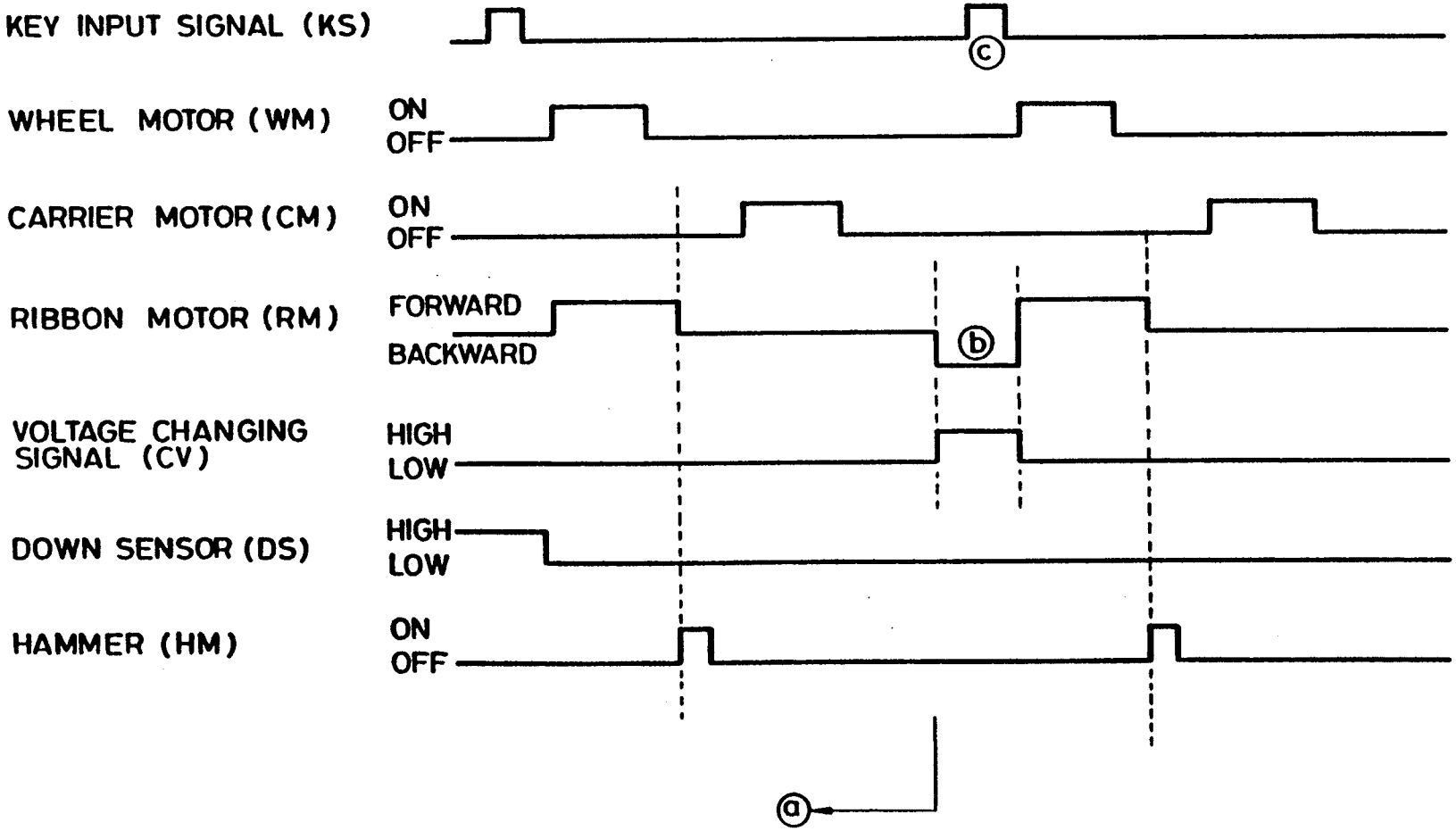

FIG. 28 is a timing chart showing the printing sequence in the case where a key input takes place while a correctable ribbon is employed and is in the down position. The sequence up to (a) is the same as that in the single printing operation shown in FIG. 26. In the case where a key input (c) is present again in the course of descent (b) of the ribbon after printing, the wheel motor is energized to select a character. At the same time the reverse rotation of the ribbon motor with the high-level voltage is interrupted to terminate the descent of the ribbon, and the ribbon motor is driven forward with the low-level voltage to elevate the ribbon again to the printing position. Thereafter the hammer is activated to print a character.

Figure 29:
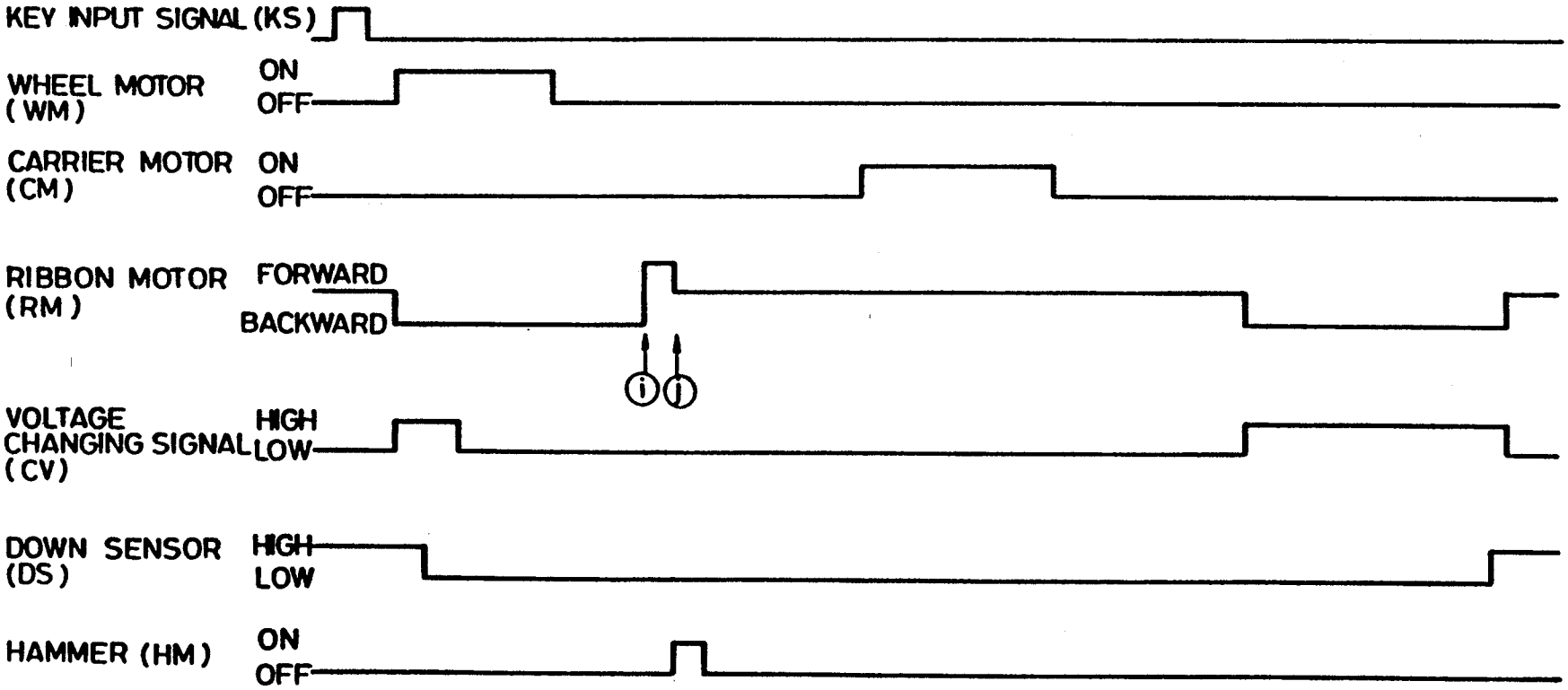

In the following there will be explained the printing sequence in the case where a multi-use ribbon is mounted. FIG. 29 is a timing chart showing the printing sequence in a single printing operation. At first, in response to a key input, the wheel motor is activated and simultaneously the ribbon motor is reversed. The reverse rotation is conducted with the high-level voltage. As will be apparent from the signal level of the down sensor, the ribbon is initially at the down position, and the cam is rotated, from the corresponding initial position shown in FIG. 4, in the direction g shown in FIG. 4, and such high-level voltage is required in order that the cam pin 23 can pass the raised portion of the cam. The ribbon motor is thereafter rotated in the reverse direction with the low-level voltage, and is rotated in the forward direction f from a point (i) shown in FIG. 29, as the ribbon is advanced between i and j in the forward rotation of the cam as explained in relation to FIG. 9-4. Thereafter the hammer is activated to print a character, and the carriage motor is then activated to move the carriage to a next printing position. In the absence of other key inputs thereafter, the ribbon motor is rotated in reverse direction from a position shown in FIG. 5 to lower again the ribbon from the printing position. Thus the cam is rotated in the direction g to lower the ribbon frame. The ribbon is not advanced since the cam is rotated in the direction g, as already explained in relation to FIGS. 10 to 11-2. After the detection of the down position of the ribbon by the down sensor, the ribbon motor is further rotated in the reverse direction by several steps and is then stopped.

Figure 30:
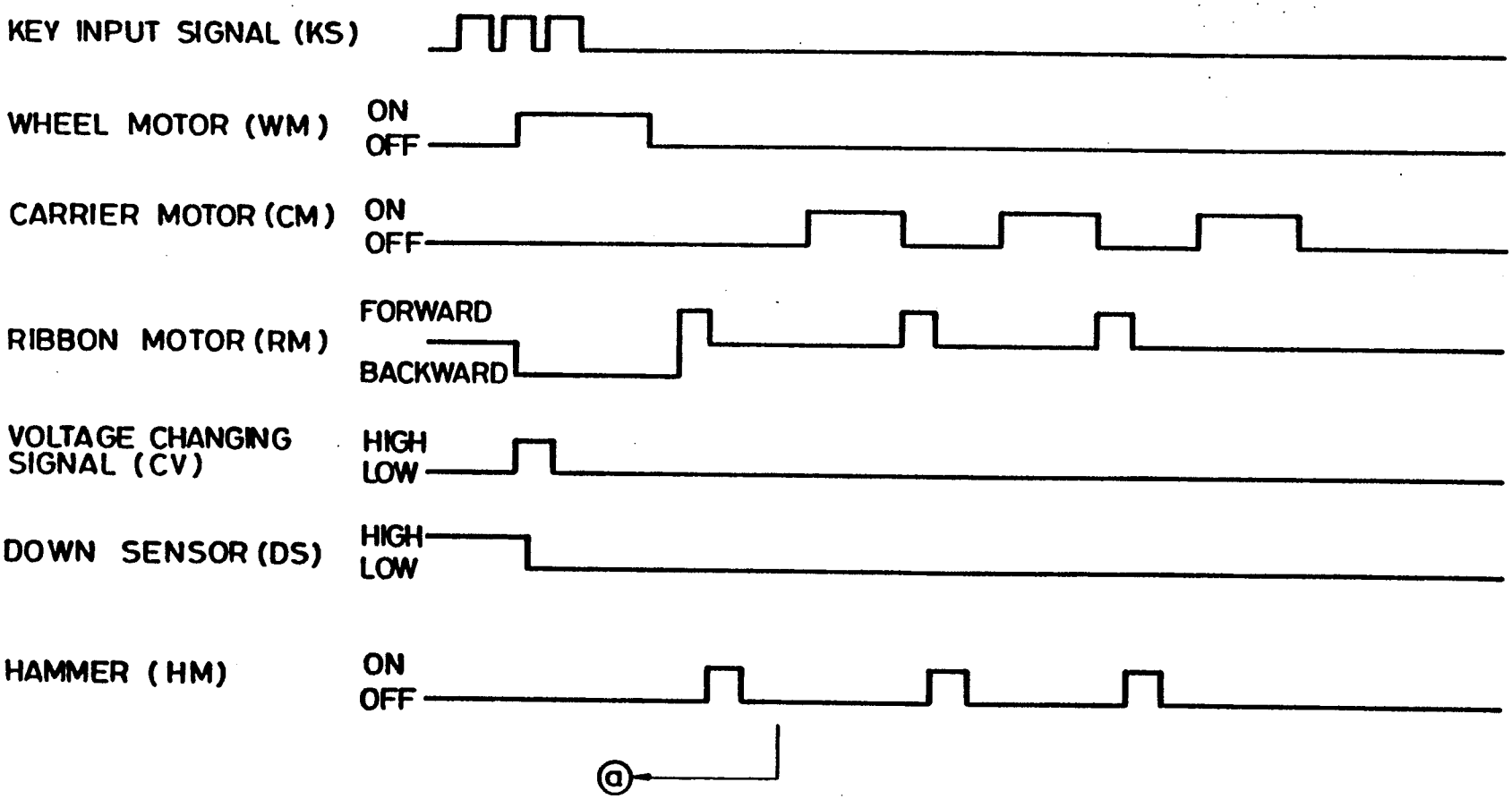

FIG. 30 shows the printing sequence in a continuous printing operation with a multi-use ribbon. The procedure up to a point (a) is the same as that shown in FIG. 29 and therefore will not be explained further. In this mode, if key inputs are given with an interval shorter than a predetermined time as shown in FIG. 27, printing operations can be conducted in continuous manner without descent of the ribbon as shown in FIG. 29. Printing speed is faster in the case of FIG. 30 than in FIG. 27 since the multi-use ribbon requires a smaller advancement, or a shorter forward rotating time of the ribbon motor.

Figure 31:
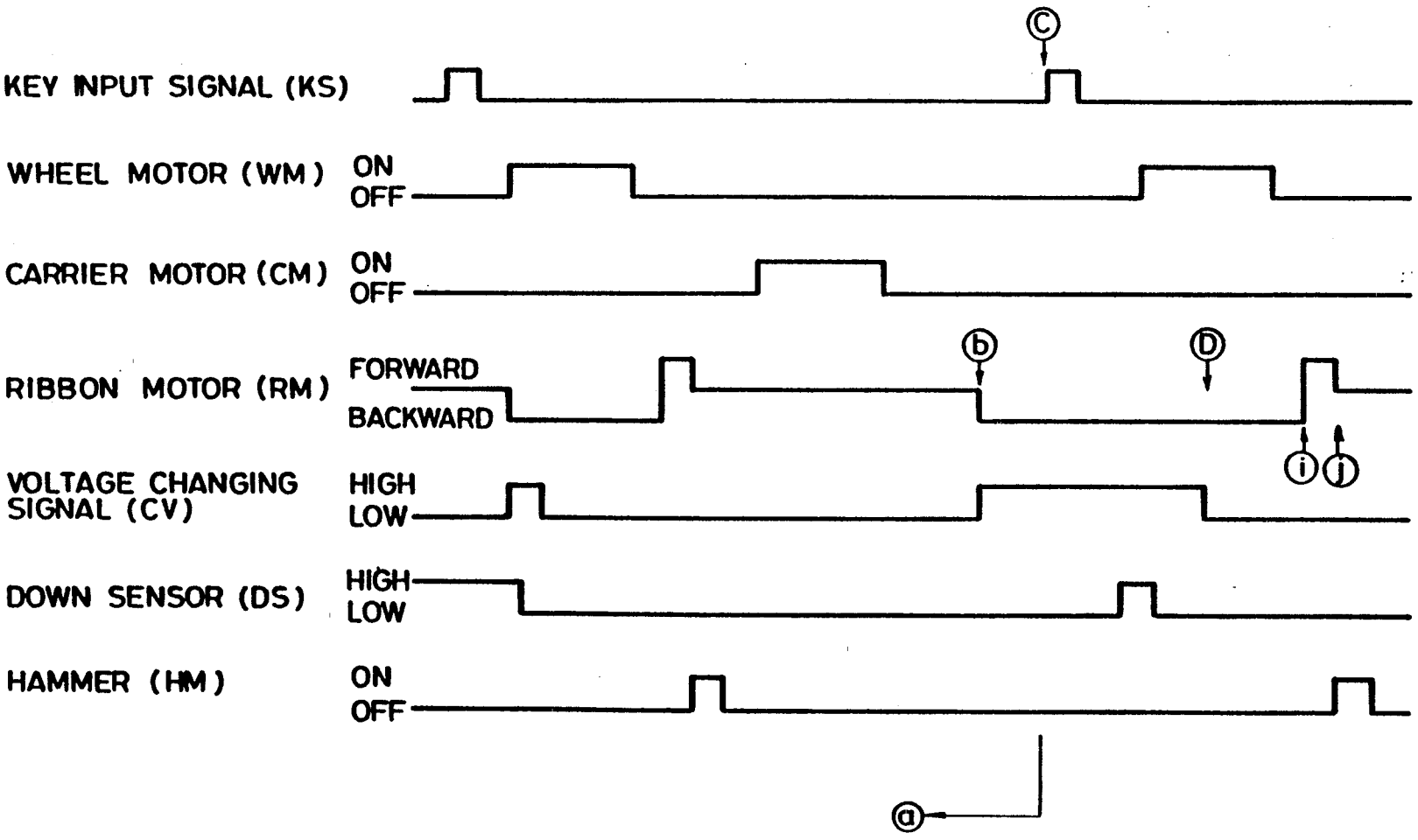

FIG. 31 shows the printing procedure in the case where a key input is given while a multi-use ribbon is in the down position. The procedure up to a point (a) is the same as that shown in FIG. 29 or 30 and therefore will not be explained further. The ribbon motor is rotated in reverse direction from a point (b), with the high-level voltage, to lower the ribbon. In the presence of a key input in the course of the ribbon descent at a point (c), the descent of the ribbon is continued and the ribbon motor continues to be rotated in the reverse direction even after the down state of the ribbon is detected by the down sensor. After a point (d), the ribbon motor continues reverse rotation since the cam pin 23 has passed the raised portion of the cam as already explained in relation to FIG. 29, and then the ribbon motor is rotated in the forward direction to advance the ribbon by a predetermined amount from a point i to j as already explained in relation to FIG. 29. During the reverse rotation of the ribbon motor, the wheel motor is activated to select a character, and, after a point j, the selected type is hit by the hammer to form a print.

Figure 32:
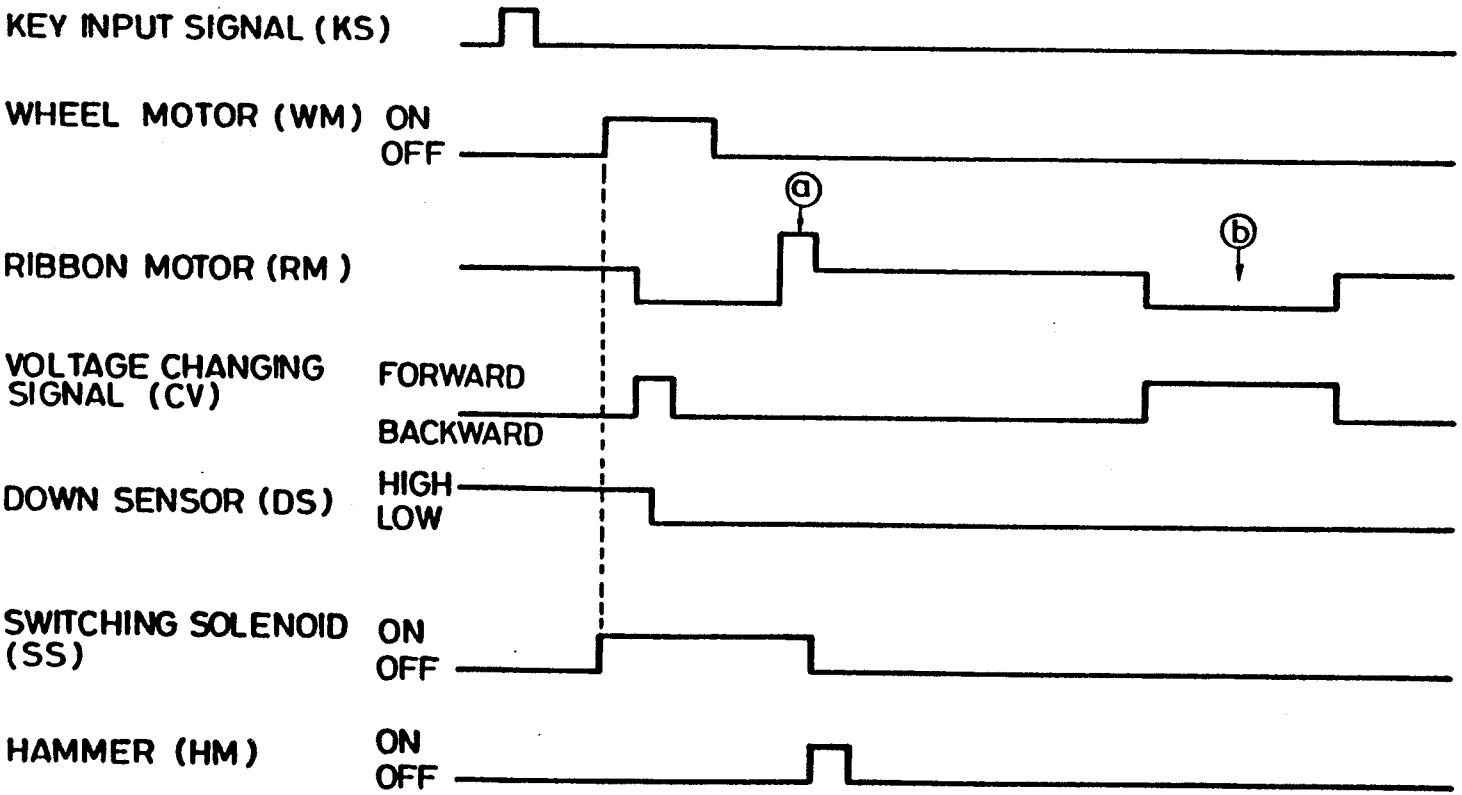
FIG. 32 is a timing chart for a corrected printing sequence.

Now reference is made to FIG. 32 for explaining the sequence of correction print. First actuated is the correction key and a character to be corrected is entered. The character may be the character printed immediately before and stored in the memory, and can therefore be automatically selected upon actuation of the correction key. When an instruction for correction is given in this manner, the wheel motor is activated to select the character to be corrected, and the switching solenoid is energized, as explained in relation to FIGS. 12 and 13, to lift the ribbon to the position shown in FIG. 6. In this state, the cam 24 and the cam pin 23 are located as shown in FIG. 4. The direction of ribbon motor rotation is reversed with the high-level voltage until the cam pin 23 passes the raised portion of the cam as already explained in relation to FIGS. 29, 30 and 31, and the reverse rotation is then continued with the low-level voltage Subsequently, at a point (a), the ribbon motor is rotated in the forward direction by a small amount to bring the cam to the maximum lift position, as already explained in FIG. 9-3. The function is similar to the ribbon advancement in the multi-use ribbon. After the ribbon is brought to the maximum lift position in this manner, the switching solenoid is deactivated and the correction ribbon is hit by the hammer to erase the already printed character. The correction ribbon may be an adhesive tape or a tape coated with white powder. After the erasure, the ribbon is lowered at a point (b), in the same manner as in FIGS. 26 and 29. It is to be noted, however, that the ribbon lowering operation in FIGS. 26 and 29 involves a change from a state shown in FIG. 5 to a state in FIG. 4, while the ribbon lowering operation in FIG. 32 involves a change from a state in FIG. 6 to a state in FIG. 4. Because of the difference in the distance of descent, the correction ribbon is advanced by a predetermined amount, by means of a ratchet mechanism, only in the descent from the correcting position shown in FIG. 32 to the down position of the ribbon.

Figure 33A:
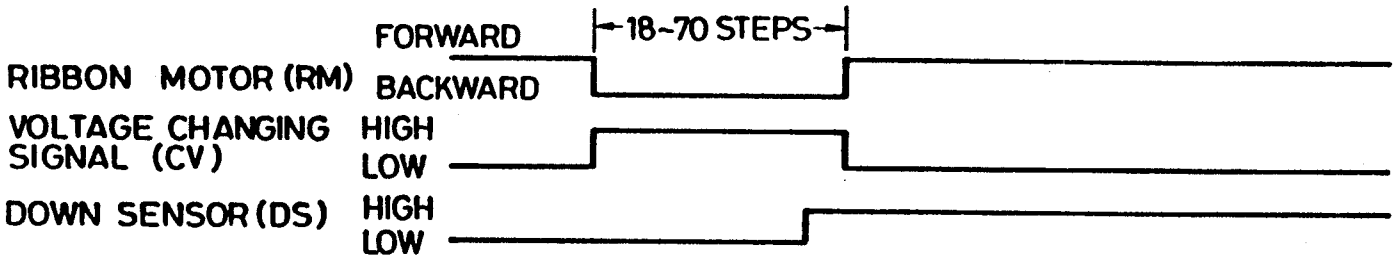
FIGS. 33A and 33B are a timing chart showing an abnormality in the down function of a ribbon frame.
Figure 33B:
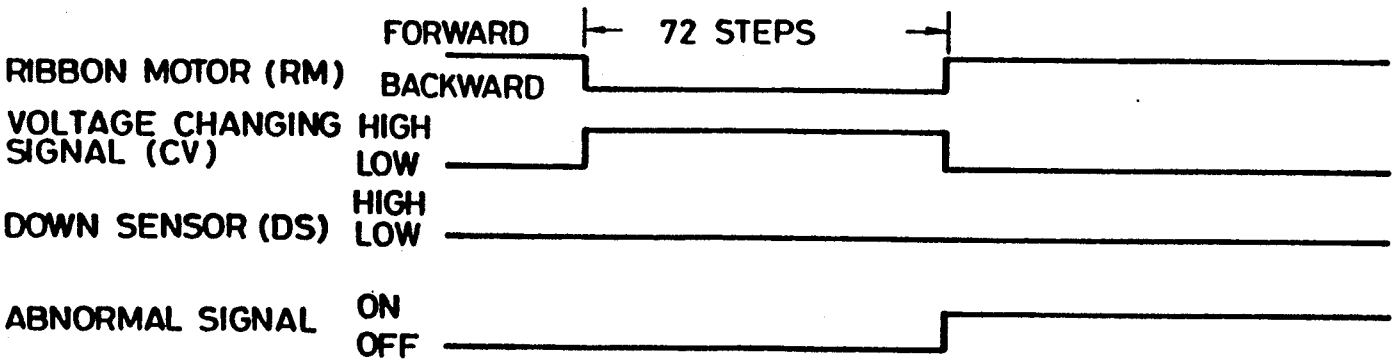

Now reference is made to FIG. 33 for explaining a procedure in the case where the ribbon frame cannot descend to the position of the down sensor 33 for detecting the down position of the ribbon frame. In FIG. 33, (*a*) is a timing chart in the ordinary lowering operation of the ribbon. The ribbon is securely lowered, in normal condition, by reverse rotation of the ribbon motor in 18 to 70 pulse steps. FIG. 33(*b*) is a timing chart showing a case in which the down sensor does not detect the down state of the ribbon when the number of steps of the ribbon motor exceeds a predetermined number, for example 72 steps, whereby an abnormality is detected and an abnormality signal is turned on to provide an alarm, for example a buzzer sound.

As previously explained in detail, the foregoing embodiment utilizes the combination of a ribbon motor and a cam to perform printing with a correctable fabric ribbon and to advance the ribbon in the forward rotation of the ribbon motor, and to lift a multi-use ribbon and a correction ribbon in the reverse rotation. Also there may be employed ribbons of different amounts of advancement since the ribbon is lifted by the reverse rotation of the ribbon motor, independently of the ribbon advancement and the ribbon motor is then rotated in the forward direction by an arbitrary amount after the ribbon is lifted. Furthermore, mass-produced inexpensive cassettes can be employed for different ribbons, since the amount of ribbon advancement can be controlled by the ribbon motor without any modification in the cassette. Different ribbons can be simply housed in such a cassette. On the other hand, the ribbon motor is driven with a high voltage only when the ribbon frame is lowered but is driven with a low voltage for ribbon advancement to avoid electric power waste and to enable control with a high duty ratio. In addition, the ribbon motor and the linear pulse motor (LPM) can have a common power supply, so that voltage switching can be achieved through a single signal line. In this manner the circuit structure can be simplified and rendered inexpensive. Furthermore, the activation of the ribbon motor is prohibited in a range of excessively high duty ratios, in order to avoid damage to the motor cause by a constant high voltage applied thereto.

In the case of an abnormality in the lowering operation of the ribbon, the lowering operation is terminated after a predetermined number of pulses to prevent damage to the apparatus, and an acoustic or visual display is provided. In this manner it is rendered possible to know the abnormality quickly and to prevent breakage of the apparatus. Furthermore, in the case where the carriage has to travel a long distance, the drive is achieved with low voltage pulses (15 V) at the accelerating and decelerating periods and with high voltage pulses (24 V) in the intermediate constant speed period, in order to abate the noise in the accelerating and decelerating stages.

Similarly, the repeated operation of the space and back space keys can be achieved with lowered noise level by a 2-phase drive in the start period and a 1-2 phase drive thereafter.

What we claimed is:

1. A printing mechanism for printing on a recording medium, comprising cam means for moving an ink ribbon between an effecting position to act on the recording medium and an initial position for not acting on the recording medium, said cam means including a cam plate having a cam groove and a cam tracing pin guided in said cam groove, with said cam tracing pin travelling a first course in said cam groove for moving the ink ribbon between the initial position and the effecting position and a second course in said cam groove for holding the ink ribbon in the effecting position;

drive means for imparting rotary motion to said cam means in two directions about a rotary axis, wherein the first course in said cam groove is eccentric with respect to the rotary axis and the second course is substantially concentric with respect to the rotary axis, wherein in a first stage of rotary motion said cam tracing pin is guided from the first course to the second course, in a second stage of rotary motion said cam tracing pin is guided in a predetermined direction in the second course and in a third stage of rotary motion said cam tracing pin is guided in the second course in a direction opposite to the predetermined direction; and prohibiting means formed in said cam groove for prohibiting said cam tracing pin from travelling off-course.

2. A printing mechanism according to claim 1, wherein said prohibiting means forms sloped portions and shoulder portion in said cam groove, and said cam tracing pin can only pass over said sloped portions.

3. A printing mechanism according to claim 1, wherein in the first stage of rotary motion imparted by said drive means a clockwise rotation winds the ink ribbon and a counter-clockwise rotation does not wind the ink ribbon.

* * * * *